US012059027B2

(12) United States Patent
Gammerler et al.

(10) Patent No.: US 12,059,027 B2
(45) Date of Patent: Aug. 13, 2024

(54) CONSISTENT TWO-CHANNEL AIR FLOW RADIANT HEATING SYSTEM FOR VAPORIZING TOBACCO AND METHOD OF USE

(71) Applicants: Gunter Gammerler, Bradenton, FL (US); Maximilian Frank, Osprey, FL (US)

(72) Inventors: Gunter Gammerler, Bradenton, FL (US); Maximilian Frank, Osprey, FL (US)

( * ) Notice: Subject to any disclaimer, the term of this patent is extended or adjusted under 35 U.S.C. 154(b) by 447 days.

(21) Appl. No.: 17/225,720

(22) Filed: Apr. 8, 2021

(65) Prior Publication Data

US 2021/0251283 A1 Aug. 19, 2021

Related U.S. Application Data

(63) Continuation-in-part of application No. 16/262,619, filed on Jan. 30, 2019, now Pat. No. 11,297,875, which is a continuation-in-part of application No. 15/254,246, filed on Sep. 1, 2016, now Pat. No. 10,206,424.

(51) Int. Cl.

| | |
|---|---|
| ***F24F 3/14*** | (2006.01) |
| ***A24F 1/30*** | (2006.01) |
| ***A24F 40/20*** | (2020.01) |
| ***A24F 40/46*** | (2020.01) |
| ***A24F 40/485*** | (2020.01) |

(52) U.S. Cl.

CPC ..... *A24F 1/30* (2013.01); *A24F 40/20* (2020.01); *A24F 40/46* (2020.01); *A24F 40/485* (2020.01)

(58) Field of Classification Search

None

See application file for complete search history.

(56) References Cited

U.S. PATENT DOCUMENTS

| | | | | | |
|---|---|---|---|---|---|
| 474,797 | A * | 5/1892 | Mitchell | F24H 3/002 | 392/375 |
| 784,981 | A * | 3/1905 | Buckley | A45D 20/12 | D23/362 |
| 813,113 | A * | 2/1906 | Pratt | D06F 49/00 | 338/319 |
| 1,161,667 | A * | 11/1915 | Hays | F24H 3/002 | 219/532 |
| 1,308,211 | A * | 7/1919 | Walder | F24H 3/002 | 338/53 |
| 1,366,840 | A * | 1/1921 | Scisinger | F24C 7/062 | 392/375 |
| 1,439,335 | A * | 12/1922 | Selvatico | F24C 15/102 | 219/460.1 |

(Continued)

*Primary Examiner* — Thor S Campbell

(74) *Attorney, Agent, or Firm* — Prometheus IP PLLC; Robert Varkonyi

(57) ABSTRACT

A radiant heater adapted to fit on the head of a hookah. The heater uses one or more resistance wire coils to generate heat which is transferred to shisha in the hookah. The heater includes an exterior chimney which surrounds the resistance ribbon and allows air to flow past the heating elements, and an interior chimney allowing cool air to mix with the heated air. The heated air further mixes with cool air drawn through a ventilation gap below the chimney and the mixed air drawn through one or more vents in a heat shield. The heat shield and hot air vaporize the shisha.

20 Claims, 19 Drawing Sheets

(56) References Cited

U.S. PATENT DOCUMENTS 1,689,822 A * 10/1928 Gallup ..... F24C 7/043 392/370
1,755,204 A * 4/1930 Buffalow ..... F24H 3/002 219/474
1,901,038 A * 3/1933 Marshall ..... F24H 3/002 338/302
2,277,151 A * 3/1942 Schoonmaker ..... F24H 3/0417 392/366
2,506,690 A * 5/1950 Stein ..... H05B 3/009 313/578
2,731,541 A * 1/1956 Houdry ..... G01N 27/16 338/261
2,900,483 A * 8/1959 Welch ..... B01J 12/005 392/491
3,119,923 A * 1/1964 Gorman ..... F24H 3/002 219/548
3,229,070 A * 1/1966 Wells ..... F24H 3/0417 415/206
3,400,248 A * 9/1968 Isomaa ..... A61H 33/063 392/374
3,492,457 A * 1/1970 Subt ..... F24H 1/103 123/549
3,889,690 A * 6/1975 Guarnieri ..... A24F 1/30 131/330
4,023,928 A * 5/1977 Haensel ..... A61L 9/03 392/375
4,133,318 A * 1/1979 Gross ..... A24F 1/30 131/193
4,523,935 A * 6/1985 Takagi ..... F01N 3/0211 219/205
D313,072 S * 12/1990 Welsh ..... D23/417
5,049,726 A * 9/1991 Higgins ..... H05B 3/742 219/462.1
5,053,603 A * 10/1991 Wagner ..... H05B 3/76 219/205
5,101,095 A * 3/1992 Wagner ..... H05B 3/76 123/549
5,334,818 A * 8/1994 Edwards ..... F24H 3/0405 392/347
6,885,810 B2 * 4/2005 Allwohn ..... A45D 20/12 392/385
7,544,331 B1 * 6/2009 Pettaway ..... B60H 1/00264 422/123
7,565,908 B2 * 7/2009 Liu ..... A24F 1/30 131/194
8,983,282 B2 * 3/2015 Bishara ..... A24F 1/30 131/173
10,206,424 B1 * 2/2019 Gammerler ..... C22C 19/058
10,537,690 B2 * 1/2020 Trzecieski ..... A24F 1/30
10,561,804 B1 * 2/2020 Culligan ..... H05B 1/025
10,820,626 B2 * 11/2020 Benjamignan ..... A24F 1/30
2006/0086365 A1 * 4/2006 Liu ..... A24F 1/30 131/173
2010/0212678 A1 * 8/2010 Bishara ..... A24F 1/30 131/173
2010/0212679 A1 * 8/2010 Bishara ..... A24F 1/30 131/173
2014/0255014 A1 * 9/2014 Bishara ..... F24H 3/002 392/488
2014/0314397 A1 * 10/2014 Alima ..... A24F 40/46 392/386
2016/0029696 A1 * 2/2016 Obeidallah ..... A24F 1/30 392/386
2016/0131360 A1 * 5/2016 Isayan ..... F22B 1/28 392/386
2019/0159514 A1 * 5/2019 Gammerler ..... A24F 1/30
2021/0251283 A1 * 8/2021 Gammerler ..... A24F 1/30

* cited by examiner

CONSISTENT TWO-CHANNEL AIR FLOW RADIANT HEATING SYSTEM FOR VAPORIZING TOBACCO AND METHOD OF USE

CROSS REFERENCE TO RELATED APPLICATIONS

This application is a continuation-in-part application of U.S. application Ser. No. 16/262,619, entitled: "Consistent Radiant Heating System for Vaporizing Tobacco and Method of Use", filed Jan. 30, 2019, which claims priority to U.S. application Ser. No. 15/254,246, entitled: "Radiant Heating System for Vaporizing Tobacco and Method of Use", filed Sep. 1, 2016, the contents of which are herein incorporated by reference in their entirety.

FIELD OF INVENTION

The invention relates generally to an electrical radiant heating system and method of vaporizing tobacco. Specifically, the invention discloses one or more electrical heating coils disposed in a chimney designed to maintain consistent temperature to heat tobacco thereby vaporizing the tobacco without burning it.

BACKGROUND OF INVENTION

Hookahs are devices used in smoking combusted materials such as tobacco. They consist of a head, body, vase, and hose. The head is a bowl formed of clay, marble, or glass, that contains coal and tobacco separated by a screen or perforated metal foil. Commonly, a windscreen is placed on the upper opening of the head, limiting air exposure to the coal, and reducing the burn rate, and hence temperature, of the coal. The body consists of a pipe that joins the head to the vase. The lower end of the pipe is submerged in water to provide a filtration system for the tobacco vapor. In some variations, a diffuser is fitted to the end of the pipe, reducing the size of the bubbles forming as air is drawn from the body into the water. The vase is a water-filled container possessing at least an input for the body and an output for one or more hoses. Finally, the hose is a material, commonly flexible, fitted to the vase and terminating in a mouthpiece, allowing a user to drawn air through the hookah, thereby heating the coals and vaporizing the tobacco, which is then drawn through the pipe and water and into the hose for inhalation by the user.

Tobacco is placed in the head of the hookah and heated to generate smoke, traditionally using charcoal that is separated from the tobacco by a perforated foil, glass, or metal screen. Hot air from the charcoal vaporizes the tobacco. Smoke vapor is drawn through a channel in the body and into the vase as a user draws air through the mouthpiece. As the body extends into water in the vase, the smoke vapor bubbles in the water, thereby filtering the raw smoke vapor. The smoke vapor then enters a head space in the vase, which is in direct communication with the one or more hoses and is drawn to the user.

The origins of the hookah are traced to Rajasthan province in north western India or Persia, and consisted of a simple and rugged structure, typically derived from a coconut shell base with a tube and head attached, which is where the alternative name for the device—nārghile (sanskrit, nārikela, coconut)—originated. In the 1500s, Abu-al Fath Gilani was attributed with the general development of the hookah as it is commonly known today. Though as the hookah was adopted in the Ottoman Empire, hookahs grew in size and complexity, and changed materials, using less wood and more brass and glass.

However, the traditional hookah rely upon charcoal, which introduces unwanted chemicals and carcinogens into the vapor smoke, and forms dirty byproducts like soot, some of which can access the tobacco. Electric solutions have thus far been unsuccessful, as the designs cause overheating of the tobacco or result in wide temperature variations in the heating element, which reduces proper vaporization and negatively affects a hookah user's experience. Furthermore, as air is drawn past the electric heating elements of previous designs, the coils cool down. Accordingly, the previous designs drop in temperature, and cease properly vaporing the tobacco, upon inhalation, or compensate by increasing the initial coil temperature, which burns the tobacco during the initial inhalation. As such, there is an unmet need in the art for a clean and effective method to vaporize tobacco.

SUMMARY OF THE INVENTION

Disclosed is a radiant heating system, comprising an upper bracket, a lower bracket, at least one heating element, an exterior chimney, an interior chimney, a ventilation gap below the exterior chimney and interior chimney, and an electrical source.

The upper bracket is optionally formed of cast aluminum, A10 aluminum, A12 aluminum, 2024-T3 aluminum, 2011 aluminum, 2014 aluminum, 2048 aluminum, 6061-T6 aluminum, 5052-H32 aluminum, 3003-H14 aluminum, 7075 aluminum, brass, gold, silver, stainless steel, or a combination thereof. The upper bracket includes an upper bracket ring or upper bracket plate, having an exterior edge face, an upper face, and a lower face. At least one heat vent disposed through the upper bracket ring or upper bracket plate and oriented such that the least one heat vent is above the heating element when the radiant heating system is assembled. In specific variations, the upper bracket includes a plurality of heat vents, such as two vents, three vents, four vents, five vents, six vents, seven vents, eight vents, nine vents, ten vents, eleven vents, or twelve vents. It is within the ordinary skill in the art to modify the size and number of vents to allow for air flow through the inventive radiant heater. At least one cool air vent is provided through the upper bracket ring or upper bracket plate interior, and in fluid communication with the interior space of the interior chimney. The cool air vent is optionally located in the interior-most section of the upper bracket. In specific embodiments, the cool air vent is a plurality of vents, such as two vents. An upper bracket electrical plate is located on one side of the upper bracket. In some variations, at least one upper electrical bracket vent is located on the upper bracket electrical plate, such as one upper electrical bracket vent, two upper electrical bracket vents, or three upper electrical bracket vents. It is within the ordinary skill in the art to modify the size and number of vents to allow for air flow through the electrical system of the radiant heater.

Optionally, the upper bracket includes butterfly air valve disposed above the at least one cool air vent. The butterfly air valve is formed of a cover plate dimensioned to close or partially close the at least one cool air vent, at least one handle disposed on the cover plate, and a pivot point disposed on the cover plate and adapted to permit the butterfly valve to move from a first open position to at least a second closed position or partially closed position. In specific variations, the butterfly valve includes two handles, with one on each side of the cover plate. Variations of the valve have the pivot point disposed centrally on the cover plate, allowing the butterfly air valve to rotate from an open position, to a partially closed position, and to a closed position.

The lower bracket is optionally formed of cast aluminum, A10 aluminum, A12 aluminum, 2024-T3 aluminum, 2011 aluminum, 2014 aluminum, 2048 aluminum, 6061-T6 aluminum, 5052-H32 aluminum, 3003-H14 aluminum, 7075 aluminum, brass, gold, silver, stainless steel, or a combination thereof, and is composed of a lower bracket ring or lower bracket plate. An exterior chimney support disposed on an upper face of the lower bracket ring or lower bracket plate and dimensioned to permit an exterior chimney to fit onto the support. An interior chimney support is disposed on an upper face of the lower bracket ring or lower bracket plate and interior to the exterior chimney support. In some variations, a plurality of lower ring spacer mounts, such as bars, extend from the lower bracket ring to the interior chimney support. The lower ring spacer mounts are optionally bars or tubes having a first end and a second end, such that the first end of the lower ring spacer mount is disposed on the interior of the lower bracket ring and the second end of the lower ring spacer mount is disposed on the interior chimney support. A plurality of projections or opening is disposed below the lower bracket ring or lower bracket plate and forms at least one ventilation gap. The ventilation gap (referenced later as ventilation gap A) is between about 0.5 mm and about 3 mm. Non-limiting examples include 0.4 mm, 0.5 mm, 0.6 mm, 0.7 mm, 0.75 mm, 0.8 mm, 0.9 mm, 1.0 mm, 1.25 mm, 1.5 mm, 1.75 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, or 3.3 mm. In some variations, the ventilation space is 3 mm.

A lower bracket electrical plate or support is disposed on one side of the lower bracket ring or lower bracket plate. Optionally, a compression end is located on the terminal end of the lower bracket electrical plate or support, and includes a first partial compression slot partially disposed in the compression end of the lower bracket electrical plate or support. A compression plate is dimensioned to fit on the compression end of the lower bracket electrical plate or support, in these variations of the invention. The compression plate includes a compression face and a second compression slot disposed on the compression face and dimensioned to fit with the first partial compression for form a full compression slot. Some variations include an electrical connector slot disposed in the lower bracket electrical plate or support.

The heating element is formed of one or more heating coils of resistance wire, and a heating element electrical connector formed of electrically conductive material disposed on the exterior end of the one or more heating coils. The resistance wire can be an alloy of nickel, aluminum, copper, manganese, iron, chromium, and silicon. Non-limiting examples include an alloy of nickel (80%) to chromium (20%), an alloy of iron (62.5%-76%) to chromium (20%-30%) to aluminum (4%-7.5%), an allow of copper (55%) to nickel (45%), an alloy of copper (86%) to manganese (12%) to nickel (2%), or an alloy of nickel (75%) to chromium (20%) to aluminum (2.5%) to copper (2.5%). The heating element is optionally one heating coil, disposed in a single coil, or two coils, one above the other. In some variations having two heating coils, the invention uses an upper heating coil comprising a resistive ribbon having a first end and a second end where the first end of the upper heating coil is circumscribed by the upper heating coil and the second end of the upper heating coil extends from a coil in the upper heating coil to form an upper heating element electrical connector, and a lower heating coil comprising a resistive ribbon having a first end and a second end where the first end of the lower heating coil is circumscribed by the lower heating coil and the second end of the lower heating coil extends from a coil in the lower heating coil to form a lower heating element electrical connector. The upper heating coil electric connector provides electrical energy to the upper heating coil, while the lower heating coil electric connector provides electrical energy to the lower heating coil. In specific variations, the upper heating coil is wired in a parallel circuit to the lower heating coil. Alternatively, the electrical connectors provide electrical connections for a single circuit.

The one or more heating coils are formed of resistance ribbon. In some embodiments, the resistance ribbon possesses a thickness and width of about 0.0285 inches x about 0.1875 inches (0.72 mm×4.7 mm). For example, the ribbon can have a thickness of 0.025 inches, 0.026 inches, 0.027 inches, 0.0275 inches, 0.028 inches, 0.0285 inches, 0.029 inches, 0.0295 inches, 0.030 inches, 0.0305 inches, 0.031 inches. The ribbon can have an exemplary width of 0.165 inches, 0.170 inches, 0.175 inches, 0.18 inches, 0.1825 inches, 0.185 inches, 0.1875 inches, 0.189 inches, 0.19 inches, 0.1925 inches, 0.195 inches. However, these numbers are examples only and not intended to be limiting. Of particular note, the wire should possess dimensions sufficient to form a heating element having a final impedance of about 0.70. Nonlimiting examples include 0.6Ω, 0.625Ω, 0.65Ω, 0.66Ω, 0.67Ω, 0.68Ω, 0.69Ω, 0.70Ω, 0.71Ω, 0.72Ω, 0.725Ω, 0.73Ω, 0.74Ω, 0.75Ω, 0.76Ω, 0.77Ω, 0.78Ω, 0.79Ω, and 0.80Ω. Increasing the width and/or thickness reduces resistance and requires a longer length to obtain the resistance needed. However, it would be known to one of skill in the art to form the required resistance ribbon. The heating coils optionally possess a circular cross section, triangular cross section, square cross section, pentagonal cross section, hexagonal cross section, heptagonal cross section, octagonal cross section, or nonagonal cross section. The thickness of the upper heating element (referenced later as height D) is optionally between 9.7 mm and 11.7 mm. In specific variations, the thickness, or height, is 9.7 mm, 9.8 mm, 9.9 mm, 10.0 mm, 10.1 mm, 10.2 mm, 10.3 mm, 10.4 mm, 10.5 mm, 10.6 mm, 10.7 mm, 10.8 mm, 10.9 mm 11.0 mm, 11.1 mm, 11.2 mm, 11.3 mm, 11.4 mm, 11.5 mm, 11.6 mm, or 11.7 mm. In specific embodiments, the upper heating element and the lower heating element are the same thickness.

The distance from the upper edge of the upper heating element to the lower face of the upper bracket, i.e. the space from the uppermost heating element to the bottom face of the upper bracket (referenced later as height C), is between 1.9 mm and 2.4 mm. In specific embodiments, the thickness, or height, is 1.9 mm, 2.0 mm, 2.1 mm, 2.2 mm, 2.3 mm, or 2.4 mm.

The heating coils are optionally connected by an interior coil link or interior coil connector. The interior coil link is formed of an electrically conductive material disposed 90 degrees to the upper heating coil and in electrical communication with the upper heating coil and disposed 90 degrees to the lower heating coil and in electrical communication with the lower heating coil. In specific variations, the interior coil link is made of resistance wire, HH-rated copper or aluminum wire (National Electrical Code, ANSI/NFPA70 of the National Fire Protection Association (NFPA); American National Standards Institute (ANSI)), steel or steel alloys such as stainless steel, or other conductive materials capable of withstanding temperatures above 1000° F. The interior coil connector is formed of an upper interior coil connector, a lower interior coil connector, and an interior coil link. The upper interior coil connector is disposed 90 degrees to the upper heating coil and in electrical communication with the upper heating coil, and the lower interior coil connector is disposed 90 degrees to the lower heating coil and in electrical communication with the lower heating coil. The interior coil connectors are formed of an electrically conductive material capable of withstanding temperatures above 1000° F., such as resistance wire, HH-rated copper or aluminum wire. The interior coil link is dimensioned to accept the upper interior coil connector and the lower interior coil connector, and is made of electrically conductive material capable of withstanding temperatures above 1000° F., such as resistance wire, HH-rated copper or aluminum wire, steel or steel alloys such as stainless steel.

In some variations, the heating coil electric connectors are optionally separated by a coil connector mount. The coil connector mount is dimensioned to accept the upper heating coil electric connectors on an upper portion of the mount and accept the lower heating coil electric connectors on a lower portion of the mount. The coil connector mount is optionally formed of an insulated material. Nonlimiting examples include Macor™, a fluorphlogopite mica-borosilicate ceramic having a composition of about 46% silica, about 17% magnesium oxide, about 16% aluminum oxide, about 10% potassium oxide, about 7% boron trioxide, and about 4% fluorine. The insulation is alternatively a composition of 65-70% silica, 20-25% aluminum trioxide ($Al_2O_3$), less than 1% magnesium oxide, less than 1% calcium oxide, 3-5% potassium/sodium oxide (K, $Na_2O$), less than 1% titanium dioxide, 102% iron oxide ($Fe_2O_3$), and 1-2% chromium oxide ($Cr_2O_3$). The insulation is optionally AP 508 gray porcelain (Akron Porcelain & Plastics Co., Akron, OH).

The exterior chimney is defined by at least one wall and dimensioned to accept the at least one heating element within the interior space, i.e. is structured to circumscribe a portion of the heating element. In some variations, the chimney is dimensioned to accept the first heating coil within the interior space of the exterior chimney. In specific variations, the exterior chimney also accepts a portion of the second heating coil. The chimney optionally has a circular cross section, triangular cross section, square cross section, pentagonal cross section, hexagonal cross section, heptagonal cross section, octagonal cross section, or nonagonal cross section, and is formed from any material known in the art that is capable of handling temperatures in excess of 600° F. Nonlimiting examples include heat-treated glass, borosilica glass, stainless steel, steel, and aluminum. The height of the exterior chimney, i.e. the distance between exterior chimney upper edge and exterior chimney lower edge, (referenced later as height B) is between 16 mm and 20 mm. In specific variations, the height is 16 mm, 16.2 mm, 16.4 mm, 16.6 mm, 16.8 mm, 17.0 mm, 17.2 mm, 17.4 mm, 17.6 mm, 17.7 mm, 17.8 mm, 17.9 mm, 18.0 mm, 18.1 mm, 18.2 mm, 18.3 mm, 18.4 mm, 18.6 mm, 18.8 mm, or 20.0 mm. In some embodiments, the chimney is dimensioned such that about 50% to about 80% of the heating element is circumscribed by the chimney. In these embodiments, the distance between the exterior chimney upper edge and the lower edge of upper bracket ring, i.e. the gap between the exterior chimney and upper bracket ring (referenced later as height E) is between 11.7 mm and 14.1 mm. In specific variations, the distance is 11.7 mm, 11.9 mm, 12.0 mm, 12.1 mm, 12.3 mm, 12.5 mm, 12.6 mm, 12.7 mm, 12.8 mm, 12.9 mm, 13.0 mm, 13.1 mm, 13.2 mm, 13.3 mm, 13.5 mm, 13.7 mm, 13.9 mm, or 14.1 mm. As such, the uppermost edge of the heating element extends beyond the upper edge of the exterior chimney. In some variations, a second heating coil is disposed above the chimney, i.e. is not circumscribed by the chimney.

The interior chimney is defined by at least one wall and dimensioned such that the exterior wall is circumscribed by the heating element, i.e. fits within the inner coil of the at least one heating coil. The chimney optionally has a circular cross section, triangular cross section, square cross section, pentagonal cross section, hexagonal cross section, heptagonal cross section, octagonal cross section, or nonagonal cross section, and is formed from any material known in the art that is capable of handling temperatures in excess of 800° F. Nonlimiting examples include heat-treated glass, borosilica glass, stainless steel, steel, and aluminum. In some embodiments, the chimney is dimensioned such that the interior chimney runs from the lower bracket to the upper bracket and is circumscribed by the heating element.

Variations of the invention include a heat shield disposed below the lower bracket. The heat shield is formed of a heating plate body, having an upper face and a lower face and at least one a heating plate vent disposed through the heating plate body. Nonlimiting examples of useful materials for the heating plate body include a metal plate of cast aluminum, A10 aluminum, A12 aluminum, aluminum foil, brass, gold, or stainless steel. Optionally, at least one heating plate mounting point is located on the upper face of the heating plate body, and oriented to align with lower ring spacer mounts of the lower bracket. In specific variations of this embodiment, the heating plate mounting points and lower ring spacer mounts cooperate to for the aforementioned ventilation gap. Specific variations of the heat shield include at least one heating projection disposed on the lower face of the heating plate body. The at least one heating projection is optionally disposed on the lower face of the heating plate body and extending from the lower face of the heating plate body. Nonlimiting examples of the at least one heating plate projection include a semispherical projection, an arc-shaped tubular projection, a cylindrical projection, a polygonal projection, a rectangular channel projection, a semispherical channel projection, or a combination thereof.

In some variations, the one or more heating elements are oriented using at least one upper spacer and at least one lower spacer. In these embodiments, the at least one upper spacer includes an upper spacer body having a lower face and an upper face and formed of a thermal insulated material. Nonlimiting examples of the thermal insulated material include Macor™, a composition of 65-70% silica, 20-25% aluminum trioxide ($Al_2O_3$), less than 1% magnesium oxide, less than 1% calcium oxide, 3-5% potassium/sodium oxide (K, $Na_2O$), less than 1% titanium dioxide, 102% iron oxide ($Fe_2O_3$), and 1-2% chromium oxide ($Cr_2O_3$), or AP 508 gray porcelain (Akron Porcelain & Plastics Co., Akron, OH). The upper face of the upper spacer body is dimensioned to fit into a slot in the lower face of the upper bracket. In some variations, at least one bracket finger disposed on the lower face of the upper spacer or spacers. The bracket finger is a projection having slots on either side that are dimensioned to accept the resistance wire along its thickness. In specific variations, the upper spacer or spacers have multiple bracket fingers, allowing each coil of the heating element's heating coil to be separated and electrically isolated from the other coils. This has the benefit of limiting potential short circuits from the electrically conductive material of the heating elements coming into contact with one another.

The at least one lower spacer includes a lower spacer body having a lower face and an upper face and at least one insulated bracket finger disposed on the upper face of the lower spacer. The lower spacer optionally uses thermal insulated material, similar to that disclosed for the upper spacer. The bracket finger is a projection having slots on either side that are dimensioned to accept the resistance wire along its thickness. In specific variations, the lower spacer or spacers have multiple bracket fingers, allowing each coil of the heating element's heating coil to be separated and electrically isolated from the other coils. The lower face of the lower spacer body optionally includes a shim, with a correlative shim channel disposed in the lower bracket. The shim channel is disposed interior to the exterior chimney support and dimensioned to accept the shim disposed on the lower face of the at least one lower spacer.

Some variations of the radiant heating system include at least one middle spacer having a middle spacer body having a lower face and an upper face and at least one insulated bracket finger disposed on the upper face of the middle spacer, and at least one insulated bracket finger disposed on the lower face of the middle spacer. The spacer optionally uses thermal insulated material, similar to that disclosed for the upper spacer. The bracket finger is a projection having slots on either side that are dimensioned to accept the resistance wire along its thickness. In specific variations, the middle spacers have multiple bracket fingers, allowing each coil of the heating element's heating coil to be separated and electrically isolated from the other coils.

The insulated spacers are optionally configured to hold the heating coil or heating coils in place in the radiant heater, including those sections within the chimney. These spacers optionally support the upper edge and lower edge of the heating elements. In examples of the invention including multiple heating coils, the upper spacer supports the uppermost heating coil and the lower spacer supports the lowermost heating coil. The optional middle spacer supports the lower edges of the upper heating coil and the upper edges of the lower heating coil.

The radiant heating system optionally includes an electrical source in an electrical communication with the at least one heating coil. Nonlimiting examples include a current-regulated electrical source. However, voltage-regulated electrical sources are also contemplated. The electrical source is optionally current adjustable. Useful adjustments in the current are from 5 amps to 25 amps. Nonlimiting examples include 5 amps, 5.5 amps, 6 amps, 6.5 amps, 7 amps, 7.5 amps, 8 amps, 8.5 amps, 9 amps, 9.5 amps, 10 amps, 10.5 amps, 11 amps, 11.5 amps, 12 amps, 12.5 amps, 13 amps, 13.5 amps, 14 amps, 15 amps, 16 amps, 17 amps, 18 amps, 19 amps, 20 amps, 21 amps, 22 amps, 23 amps, 24 amps, or 25 amps. The current is dependent upon the heating element, and the electrical system is optionally designed to operate between 5V and 50V. Nonlimiting examples include 5V, 6V, 7V, 8V, 9V, 10 V, 11V, 12V, 13V, 14V, 15V, 16V, 17V, 18V, 19V, 20V, 21V, 22V, 23V, 24V, 25V, 26V, 27V, 28V, 29V, 30V, 31V, 32V, 33V, 34V, 35V, 36V, 37V, 38V, 39V, 40V, 41V, 42V, 43V, 44V, 45V, 46V, 47V, 48V, 49V, or 50V.

In specific versions, the electrical source includes at least an upper heating element electrical line in electrical communication with the upper heating element connector on a first end and the electrical source on a second end, and at least a lower heating element electrical line in electrical communication with the lower heating element connector on a first end and the electrical source on a second end. In this version of the electrical source, the heating element electrical lines are an electrically conductive material. Alternatively, the electric source also includes a second channel upper heating element electrical line in electrical communication with the upper heating element on a first end and the electrical source on a second end, and a second channel lower heating element electrical line in electrical communication with the lower heating element on a first end and the electrical source on a second end. The second channel heating element electrical lines are an electrically conductive material.

BRIEF DESCRIPTION OF THE DRAWINGS

For a fuller understanding of the invention, reference should be made to the following detailed description, taken in connection with the accompanying drawings, in which:

FIG. 6(*b*) is an isometric view of an embodiment of the lower bracket of the radiant heater of the invention.

FIG. 13(*b*) is an isometric view of an embodiment of the heat shield of the radiant heater of the invention depicting cylindrical projections on the lower face of the heat shield.

FIG. 13(*c*) is an isometric view of an embodiment of the heat shield of the radiant heater of the invention depicting polygonal projections on the lower face of the heat shield.

FIG. 13(*d*) is an isometric view of an embodiment of the heat shield of the radiant heater of the invention depicting a channel projection on the lower face of the heat shield.

FIG. 13(*e*) is an isometric view of an embodiment of the heat shield of the radiant heater of the invention depicting channel projections on the lower face of the heat shield.

FIG. 13(*f*) is an isometric view of an embodiment of the heat shield of the radiant heater of the invention depicting channel projections on the lower face of the heat shield.

FIG. 13(*g*) is an isometric view of an embodiment of the heat shield of the radiant heater of the invention depicting arc-shaped projections on the lower face of the heat shield.

FIG. 13(*h*) is an isometric view of an embodiment of the heat shield of the radiant heater of the invention depicting tubular channel projections on the lower face of the heat shield.

FIG. 14(*b*) is an isometric view of an embodiment of the heat shield of an embodiment of the radiant heater of the invention.

DETAILED DESCRIPTION OF THE PREFERRED EMBODIMENT

As used herein, "about" means approximately or nearly and in the context of a numerical value or range set forth means±20% of the numerical.

As used herein, "hookah" refers to a device designed for vaporizing and smoking favored materials, the vapor of which is run through a liquid before inhalation. The hookah is typically used to smoke shisha, and may have a single host or multiple hoses for inhalation.

As used herein, "heating coil" means a heating element wrapped around itself, regardless of shape. For example, the heating coil may be spiral-shaped, with each wrap radially circumscribed by the preceding wrap, or a polygonal shape, such as triangular, square, pentagonal, hexagonal, heptagonal, and octagonal. Other shapes would be readily apparent and are envisioned in the invention.

Figure 3:
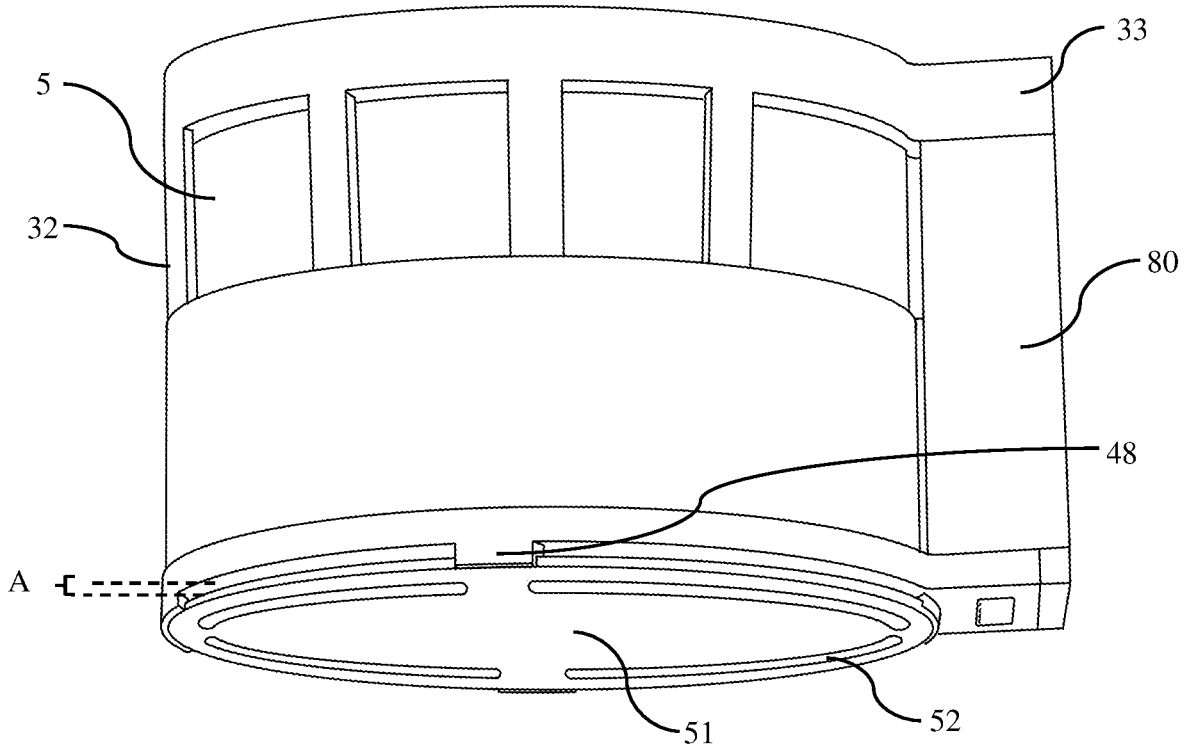
FIG. 3 is an isometric view of an embodiment of the radiant heater of the invention.

As used herein, "upper" and "lower" or "bottom" are referenced on the image depicted in FIG. 3. "Upper" means any portion of the heater directed to the top in FIG. 1. For example, reference number 5 is above reference number 7. The "upper edge" references the terminal section of an element directed at the top of the Figure. "Lower" or "bottom" is directed toward the bottom of FIG. 1.

As used herein, "ambient environment" and derivations thereof mean the environment surrounding and outside of the device, as compared to the interior regions and spaces of the device. As a non-limiting example, the ambient environment includes the humidity, temperature, and air particulates 6 inches above the heating elements.

As used herein, "projection" means any structure which by design, is raised or protrudes beyond the face of the structure upon which the projection is disposed As used herein, "circumference" means the outermost boundary of the referenced structure.

As used herein, "chimney effect", also called stack effect, is the movement of air into and out of a structure due to differential air buoyancy of hot air and warm air. The drop in density as air or gas is heated results in the air or gas rising above denser, cooler air or gas.

As used herein, "arc-shaped" means that the structure has a convex or concave shape that resemble sections of circles, ellipses, involute curves, and spirals, without forming a full circle, or ellipse.

As used herein, "disposed along" means that the structure either directly or indirectly in contacts the surface of another structure, while not physically attached to the other structure.

As used herein, "female-threaded" means a structure that has threading in a receptacle that receives a protrusion from another structure, and is used in compliance with the American National Standard Pipe Thread standards, or national pipe thread standards. In some embodiments, the term "female-threaded post" means a solid bar ending in a tubular or other hollow geometric structure that possesses one or more threads.

As used herein, "male-threaded" means a structure that has threading in on a protrusion that can be accepted by a receptacle of another structure, and is used in compliance with the American National Standard Pipe Thread standards, or national pipe thread standards.

As used herein, "resistive ribbon" means a resistance wire having a length, width, and thickness, where the width is at least 2 times the value of the thickness. In some embodiments, the resistive ribbon possesses both high resistivity and oxidation resistance.

As used herein, "a single ribbon coil" means a coil wrapped around itself, having a first terminal end outside the wrapping and a second terminal end at the core of the wrapping, regardless of shape. For example, where the heating coil is spiral-shaped, the first terminal end extends from a radially circumscribed coil and the second terminal end is disposed at the center-most point of the coil, as seen in FIGS. 14-17.

As used herein, "substantially" means largely if not wholly that which is specified but so close that the difference is insignificant. Where the term refers to an amount, "substantially" includes at least 85%, at least 90%, at least 94%, at least 95%, at least 96%, at least 97%, at least 98%, or at least 99%.

As used herein, "partially" means 75% of the entire distance or less. Non-limiting examples include 75%, 70%, 65%, 60%, 55%, 50%, 45%, 40%, 35%, 30%, 25%, 20%, 15%, 10%, 5%, or 2.5%.

Ranges disclosed herein include subsets of the specified ranges.

A hookah electric radiant heating system is provided for vaporizing tobacco without burning the tobacco. Burning or charring tobacco results in unpleasant volatile gases, ultrafine particulates and ash, which reduces the smoking experience and negatively affects the health of a hookah user. The system includes a heating element, set in an open faced mounting ring such that the heating element optionally moves in relation to the mounting ring to control heat. The system is designed to transfer heat to a heat transfer plate which applies heat to tobacco in a hookah head.

Example 1

Figure 1:
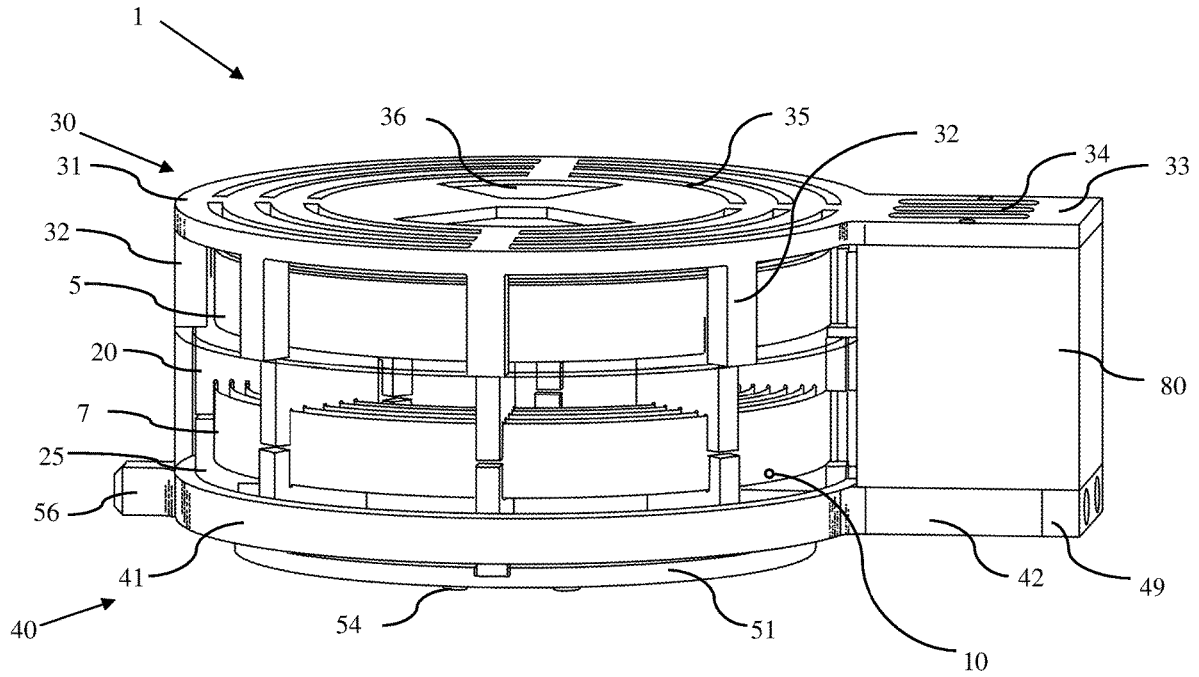
FIG. 1 is an isometric view of an embodiment of the radiant heater of the invention.

Radiant heater 1 is composed of one or more heating elements, upper bracket 30, lower bracket 40, exterior chimney 10, interior chimney 15, and heating element spacers, seen in FIG. 1.

Figure 2:
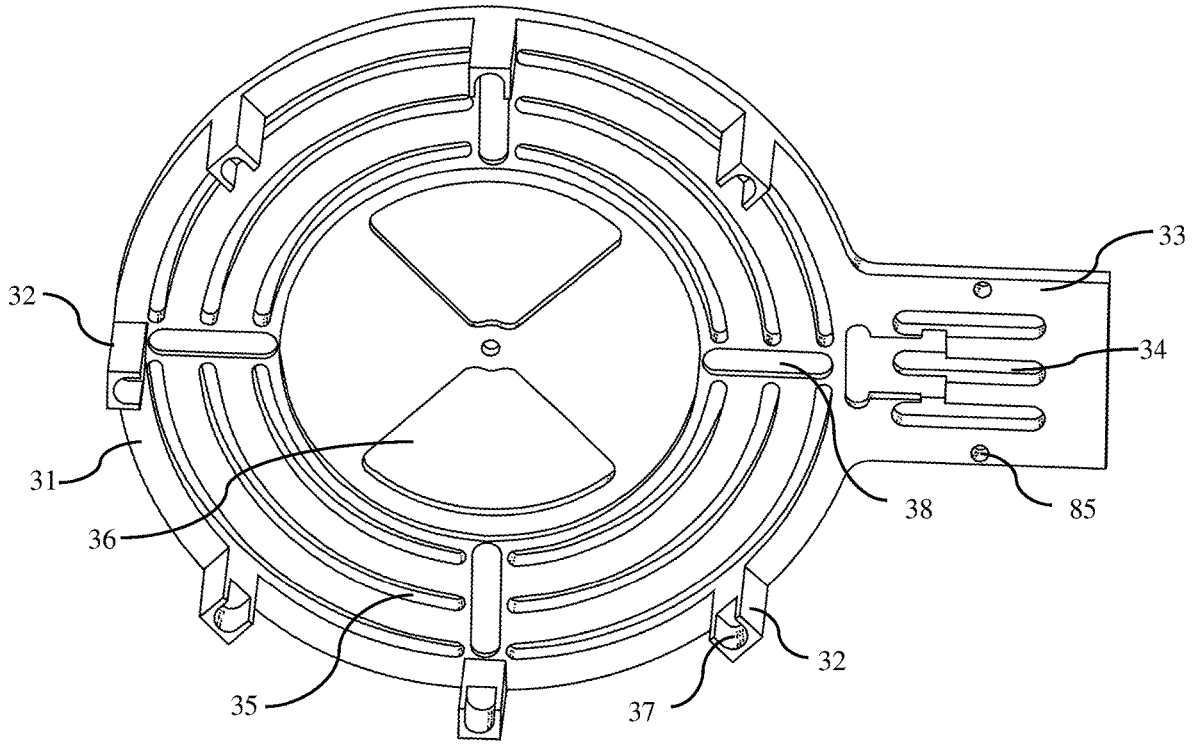
FIG. 2 is an isometric view of an embodiment of the upper bracket of the radiant heater of the invention.

Upper bracket 30 is formed of cast aluminum, and is composed of upper bracket ring 31 with a plurality of upper ring mount 32 disposed on a lower face of the upper bracket ring. Upper bracket ring 31 joins to one side to upper bracket plate 33, though upper bracket ring 31 and upper bracket plate 33 are in most cases formed of one piece. At least one upper electrical bracket vent 34 is disposed on upper bracket plate 33. Upper ring mount 32 includes ring lower spacer mount 37 disposed on the interior face of the mount, as seen in FIG. 2. Ring lower spacer mount 37 is dimensioned to accept a portion of a heating element spacer. The lower face of upper bracket ring 31 includes ring upper spacer mount 38. The upper spacer mount is seen as an indent in the upper bracket ring, and is dimensioned to accept spacers.

Upper bracket ring 31 includes at least one upper heating bracket vent 35 disposed through the upper bracket, thereby permitting heated air to escape from the radiant heater and cool air to be drawn into the radiant heater. However, in some variations a plurality of vents are optionally disposed on the ring. Upper heating bracket vent 35 is depicted as a slot in the upper bracket ring, but may alternatively be a plurality of holes in the upper bracket. At least one upper heating opening 36 is similarly disposed centrally on the upper bracket ring, allowing air to be drawn through the opening and into the interior chimney.

Lower bracket 40 is formed of cast aluminum, and is composed of lower bracket ring 41 having lower ring mount 56 on a first side, and lower bracket plate 42 opposite lower ring mount 56. Lower bracket plate 42 includes electrical connector slot 43, which is formed of at least a channel. Exterior spacer shim lip 47 is disposed concentrically to, and interior to, lower bracket ring 41. Lower bracket 40 includes interior chimney spacer 45, disposed centrally to the lower bracket ring and connected to lower bracket ring 41 via one or more lower ring spacer mount 46. Lower bracket plate 42 terminates in bracket compression face 42*b* and a portion of compression slot 44. Compression plate 49 is disposed adjacent to compression face 42*b* and includes compression face 42*c*, dimensioned to fit on bracket compression face 42*b* of lower bracket plate 42, and a portion of compression slot 44.

Interior chimney 15 is made of borosilicate glass, or a material possessing similar thermal properties. Interior chimney 15 is tubular and includes interior chimney upper edge 15*a* and interior chimney lower edge 15*b*, and permits air flow from upper bracket 30 to lower bracket 40. Interior chimney lower edge 15*b* has the same general circumference as interior chimney spacer 45 and is dimensioned to fir onto interior chimney spacer 45.

Exterior chimney 10 is made of borosilicate glass, or a material possessing similar thermal properties, and includes exterior chimney upper edge 10*a* and exterior chimney lower edge 10*b*. Exterior chimney 10 is tubular and dimensioned to permit air flow past the heating element or heating elements. The exterior chimney is fixed by the lower bracket ring of lower bracket 40 and upper ring mount 32 of upper bracket 30.

Upper heating element 5 includes upper heating element electrical connector 6 disposed on the outermost coil of the heating element. Upper heating element electrical connector 6 is formed of the same material as upper heating element 5 or other electrically conductive material.

A plurality of upper spacers 20 are formed of a fluorphlogopite mica-borosilicate ceramic insulation. The spacer is formed of upper spacer top element finger spacers 21, disposed on the upper face of the upper spacer and dimensioned to hold the coils of upper heating element 5. Upper spacer bottom element finger spacers 22, disposed on the lower face of the upper spacer and dimensioned to hold the coils of lower heating element 7.

Lower heating element 7 includes lower heating element electrical connector 8 disposed on the outermost coil of the heating element. Lower heating element electrical connector 8 is formed of the same material as lower heating element 7, or other electrically conductive material.

A plurality of lower spacers 25 are formed of a fluorphlogopite mica-borosilicate ceramic insulation. The spacer is formed of lower spacer top element spacers 26, disposed on the upper face of the lower spacer and dimensioned to hold the coils of lower heating element 7. Lower spacer shim 27 is disposed on the lower face of the lower spacer and dimensioned to fit in. exterior spacer shim lip 47 of lower bracket 40.

Heat shield 50 is formed of cast aluminum and includes heating plate 51. At least one heating plate vent 52 is disposed in heating plate 50 and extends from the top face of the heating plate to the bottom face of the plate. A plurality of heating plate mounting points 53 are disposed on the top face of heating plate 51 and dimensioned to accept the bottom of heating plate mount 48, as seen in FIG. 3. The interaction between heating plate mount 48 and heating plate mounting point 53 form ventilation gap A between lower bracket 40 and heat shield 50, where the ventilation gap is between 0.5 mm and 3 mm.

Example 2

Figure 4:
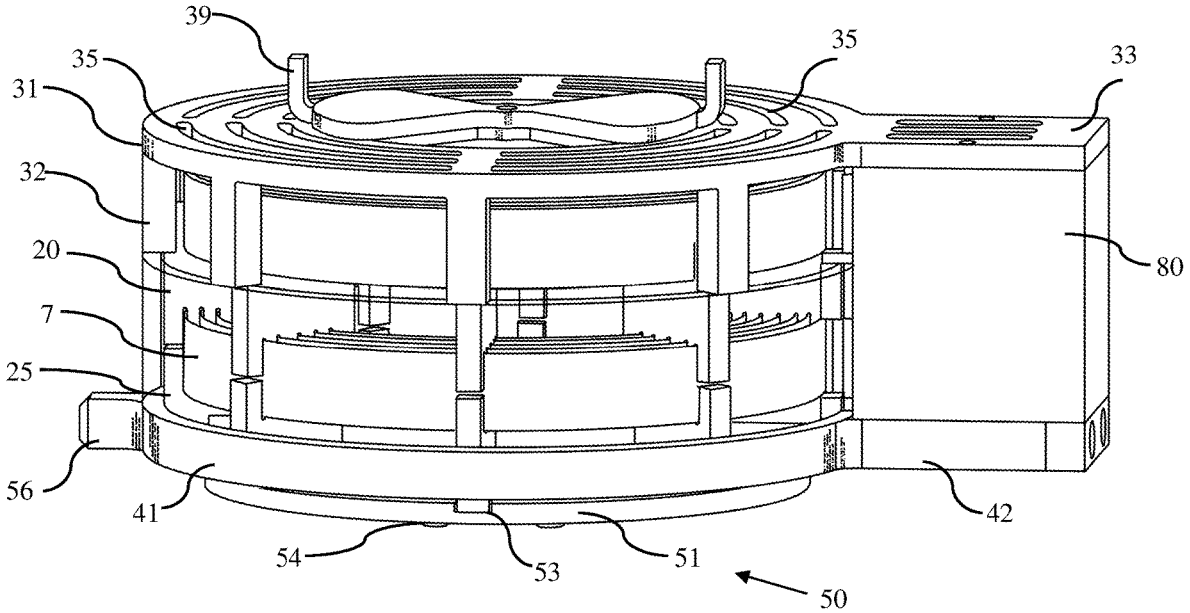
FIG. 4 is an isometric view of an embodiment of the radiant heater of the invention.

Radiant heater 1 is shown similar to the embodiment of Example 1, having one or more heating elements, upper bracket 30, lower bracket 40, exterior chimney 10, interior chimney 15, and heating element spacers, seen in FIG. 4.

Upper bracket 30 is formed of cast aluminum, and formed of upper bracket ring 31 with a plurality of upper ring mounts 32 disposed on a lower face of the upper bracket ring, upper heating bracket vent 35, upper heating opening 36, and upper bracket plate 33. Butterfly air valve 39 is rotatably disposed on the upper face of upper bracket ring 31, and dimensioned to partially or fully close, based on the position of the air valve.

Figure 5:
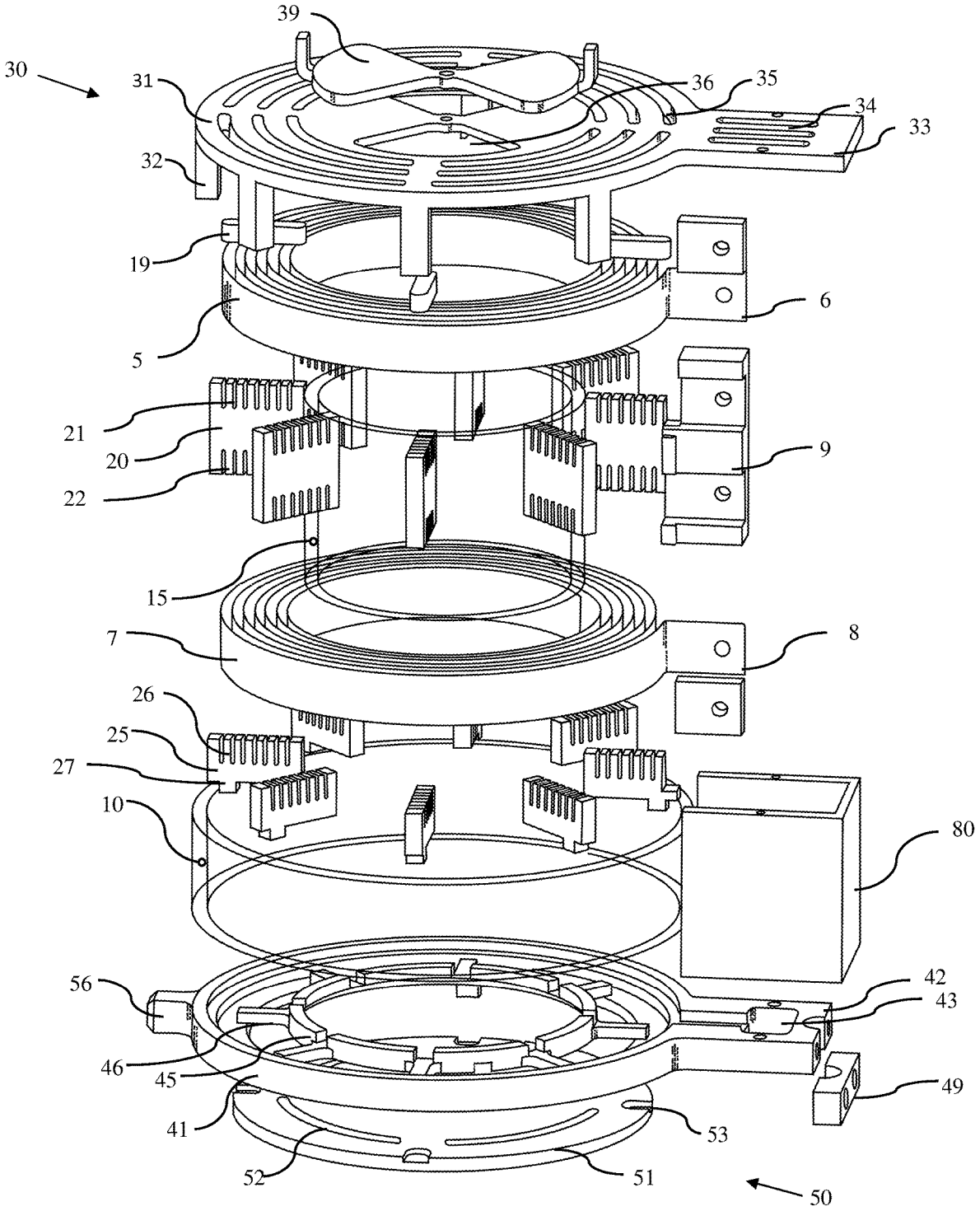
FIG. 5 is an isometric view of a breakaway view of an embodiment of the radiant heater of the invention.
Figure 6A:
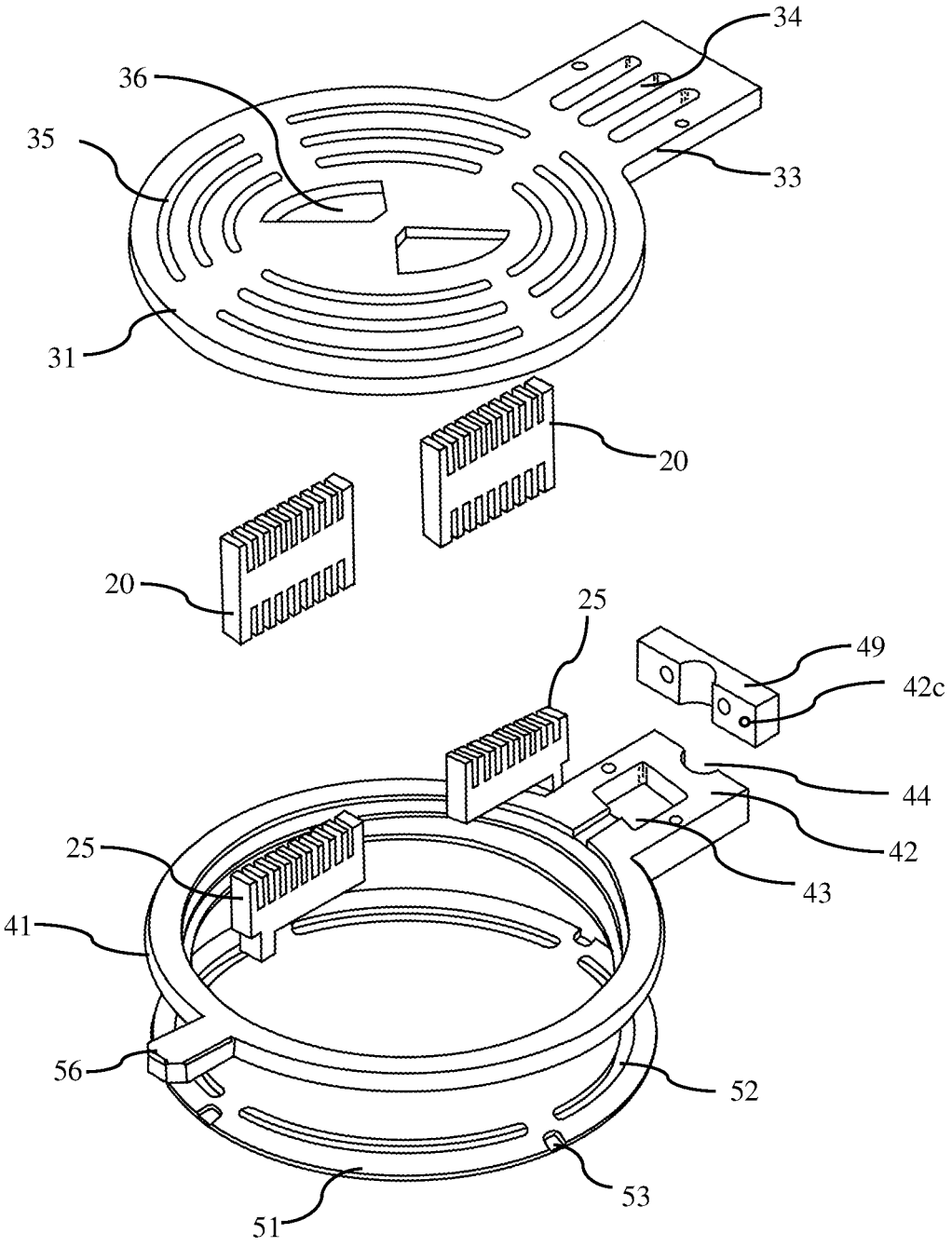
FIG. 6(*a*) is an isometric view of a breakaway view showing the brackets and spacers of an embodiment of the radiant heater of the invention.
Figure 6B:
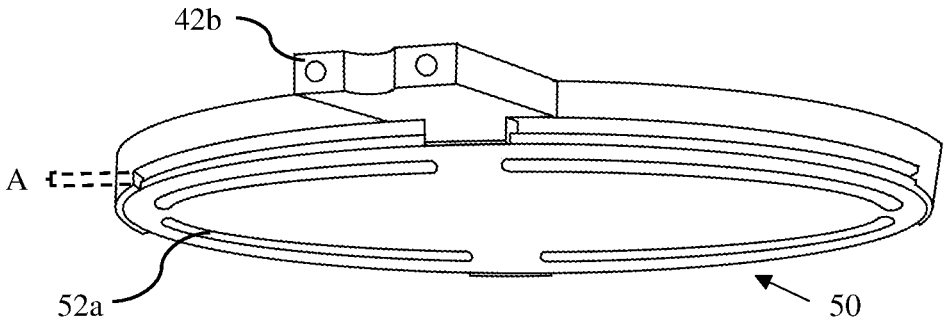

Lower bracket 40 is formed of cast aluminum, and is composed of lower bracket ring 41 having lower ring mount 56 on a first side, and lower bracket plate 42 opposite lower ring mount 56, shown in FIG. 5. Lower bracket plate 42 includes electrical connector slot 43, which is formed of at least a channel. Electrical connector slot 43 optionally extends from the upper face of lower bracket plate 42 to the lower face of lower bracket plate 42. Exterior spacer shim lip 47 is disposed concentrically to, and interior to, lower bracket ring 41. Lower bracket 40 includes interior chimney spacer 45, disposed centrally to the lower bracket ring and connected to lower bracket ring 41 via one or more lower ring spacer mount 46. Lower bracket plate 42 terminates in bracket compression face 42*b* and a portion of compression slot 44. Compression plate 49 is disposed adjacent to compression face 42*b* and includes compression face 42*c*, as seen in FIG. 6(*a*), dimensioned to fit on bracket compression face 42*b* of lower bracket plate 42, as seen in FIG. 6(*b*), and a portion of compression slot 44. The lower face of lower bracket ring 41 includes a plurality of heating plate mounts 48 that extend from the lower face of lower bracket ring 41 and provide for ventilation gap A. Heating plate mount 48 optionally includes a recess to accept the edge of heating plate 51.

Interior chimney 15, seen in FIG. 5, is made of borosilicate glass, or a material possessing similar thermal properties. Interior chimney 15 is tubular and includes interior chimney upper edge 15*a* and interior chimney lower edge 15*b*, and permits air flow from upper bracket 30 to lower bracket 40. Interior chimney lower edge 15*b* has the same general circumference as interior chimney spacer 45 and is dimensioned to fir onto interior chimney spacer 45.

Exterior chimney 10 is made of borosilicate glass, or a material possessing similar thermal properties, and includes exterior chimney upper edge 10*a* and exterior chimney lower edge 10*b*. Exterior chimney 10 is tubular and dimensioned to permit air flow past the heating element or heating elements. The exterior chimney is fixed by the lower bracket ring of lower bracket 40 and upper ring mount 32 of upper bracket 30.

A plurality of shims 19 are formed of a fluorphlogopite mica-borosilicate ceramic insulation (Macor, Corning Inc., Corning, NY). Shim 19 is dimensioned to fit within ring upper spacer mount 38. Alternatively, shim 19 is shaped to include finger spacers disposed on the lower face of the shim and dimensioned to hold the coils of upper heating element 5.

Upper heating element 5 includes upper heating element electrical connector 6 disposed on the outermost coil of the heating element. Upper heating element electrical connector 6 is formed of the same material as upper heating element 5 or other electrically conductive material.

A plurality of upper spacers 20 are formed of a fluorphlogopite mica-borosilicate ceramic insulation. The spacer is formed of upper spacer top element finger spacers 21, disposed on the upper face of the upper spacer and dimensioned to hold the coils of upper heating element 5. Upper spacer bottom element finger spacers 22, disposed on the lower face of the upper spacer and dimensioned to hold the coils of lower heating element 7.

Lower heating element 7 includes lower heating element electrical connector 8 disposed on the outermost coil of the heating element. Lower heating element electrical connector 8 is formed of the same material as lower heating element 7, or other electrically conductive material.

A plurality of lower spacers 25 are formed of a fluorphlogopite mica-borosilicate ceramic insulation. The spacer is formed of lower spacer top element spacers 26, disposed on the upper face of the lower spacer and dimensioned to hold the coils of lower heating element 7. Lower spacer shim 27 is disposed on the lower face of the lower spacer and dimensioned to fit in. exterior spacer shim lip 47 of lower bracket 40.

Figure 7:
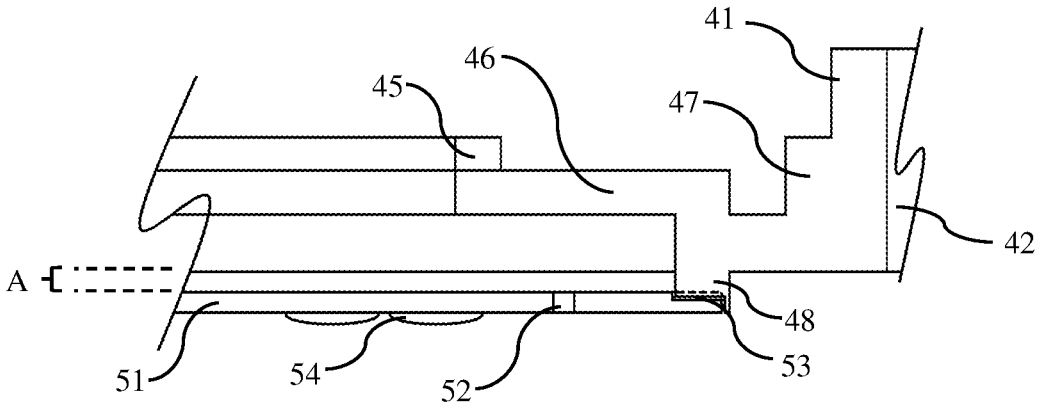
FIG. 7 is a cross-sectional, blown-up view of an embodiment of the heating element of the invention.
Figure 8:
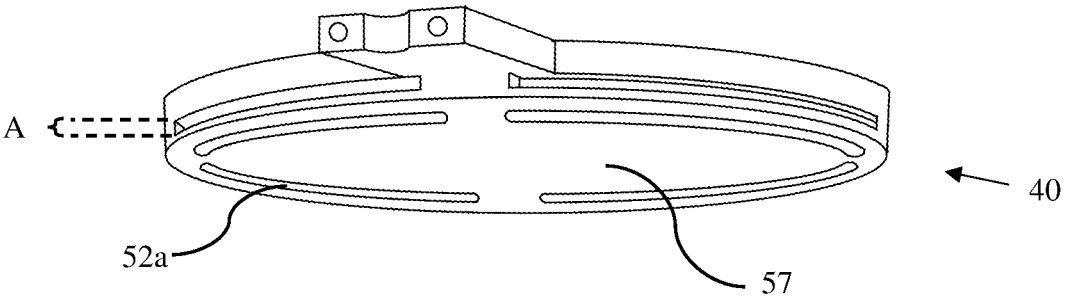
FIG. 8 is an isometric view of an embodiment of the lower bracket of the radiant heater of the invention.

Heat shield 50 is formed of cast aluminum and includes heating plate 51. At least one heating plate vent 52 is disposed in heating plate 50 and extends from the top face of the heating plate to the bottom face of the plate. A plurality of heating plate mounting points 53 are disposed on the top face of heating plate 51 and dimensioned to accept the bottom of heating plate mount 48, as seen in FIG. 7. The interaction between heating plate mount 48 and heating plate mounting point 53 form ventilation gap A between lower bracket 40 and heat shield 50, where the ventilation gap is between 0.5 mm and 3 mm. The lower face of heating plate 51 provides for a plurality of heating projections 54, shown as semispherical projections extending from the plate to heat the tobacco in the present example. In some embodiments, eight heating projections are disposed equally along the lower face of the heat shield.

An electrical supply (not shown) includes an electrically conductive and insulated cord that extends through electrical connector slot 43 and into an interior space made by electric supply housing 80. Coil connector mount 9 joins with upper heating element electrical connector 6 and lower heating element electrical connector 8 within the interior space of electric supply housing 80, and is in electrical communication with the electrical supply.

Example 3

Radiant heater 1 is shown similar to the embodiment of Example 1, having one or more heating elements, upper bracket 30, lower bracket 40, exterior chimney 10, interior chimney 15, and heating element spacers, as disclosed in the prior Examples.

Lower bracket 40 is formed of cast aluminum, and is composed of lower bracket ring 41 having lower ring mount 56 on a first side, and lower bracket plate 42 opposite lower ring mount 56, shown in FIGS. 6(*a*) and 8. Lower bracket plate 42 includes electrical connector slot 43, which is formed of at least a channel. Electrical connector slot 43 optionally extends from the upper face of lower bracket plate 42 to the lower face of lower bracket plate 42. Exterior spacer shim lip 47 is disposed concentrically to, and interior to, lower bracket ring 41. Lower bracket 40 includes interior chimney spacer 45, disposed centrally to the lower bracket ring and connected to lower bracket ring 41 via one or more lower ring spacer mount 46. Lower bracket plate 42 terminates in bracket compression face 42*b* and a portion of compression slot 44. Compression plate 49 is disposed adjacent to compression face 42*b* and includes compression face 42*c*, dimensioned to fit on bracket compression face 42*b* of lower bracket plate 42, and a portion of compression slot 44. The lower face of lower bracket ring 41 includes a plurality of extensions that extend to lower bracket heat plate 57, which is fused to the other structures of the lower bracket. Alternatively, the lower bracket, including the extensions and lower bracket heat plate, is formed from a single piece of cast aluminum. A plurality of openings are disposed adjacent to the plurality of extensions and provide for ventilation gap A.

The interior chimney, exterior chimney, spacers, and heating elements are disclosed in the prior Examples.

An electrical supply (not shown) includes an electrically conductive and insulated cord that extends through electrical connector slot 43 and into an interior space made by electric supply housing 80. Coil connector mount 9 joins with upper heating element electrical connector 6 and lower heating element electrical connector 8 within the interior space of electric supply housing 80.

Example 4

Figure 9:
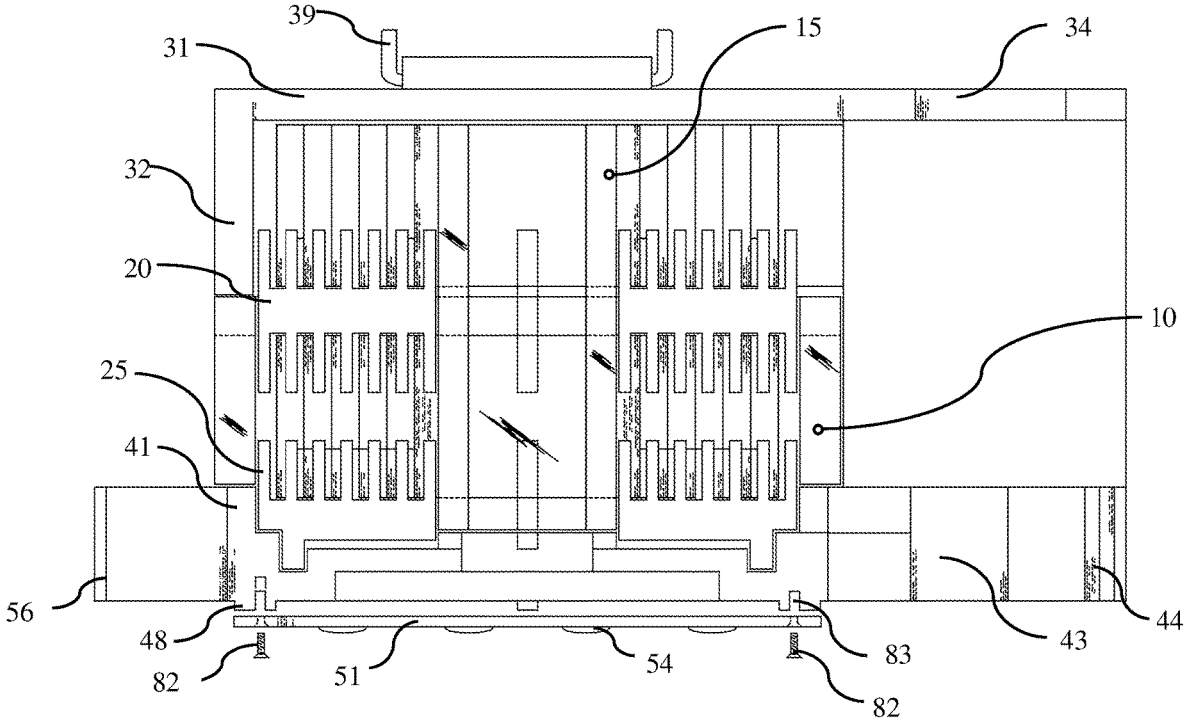
FIG. 9 is a cross-sectional view of an embodiment of the heating element of the invention.

Radiant heater 1 is shown similar to the prior Examples, having one or more heating elements, upper bracket 30, lower bracket 40, exterior chimney 10, interior chimney 15, and heating element spacers, seen in FIG. 9.

Upper bracket 30 is formed of cast aluminum, and composed of upper bracket ring 31 with a plurality of upper ring mounts 32 disposed on a lower face of the upper bracket ring, upper heating bracket vent 35, upper heating opening 36, and upper bracket plate 33. Butterfly air valve 39 is rotatably disposed on the upper face of upper bracket ring 31, and dimensioned to partially or fully close, based on the position of the air valve.

Lower bracket 40 is formed of cast aluminum, and composed of lower bracket ring 41, lower ring mount 56, exterior spacer shim lip 47, and heating plate mounts 48, similar to the lower bracket disclosed in the prior Examples. Interior chimney spacer 45 is disposed centrally to the lower bracket ring and connected to lower bracket ring 41 via one or more lower ring spacer mount 46. Lower bracket plate 42 terminates in bracket compression face 42*b* and a portion of compression slot 44. Lower bracket plate 42 includes electrical connector slot 43, which extends from the upper face of lower bracket plate 42 to the lower face of lower bracket plate 42. In this variation, heating plate mount 48 lack an indent for heat shield 50 and include mounting screw hole 83 on the lower surface. Mounting screw hole 83 is positioned and dimensioned to accept heating plate mounting screw 82 from the heat shield. Heating plate mount 48 extend from the lower face of lower bracket ring 41 and provide for ventilation gap A between lower bracket 40 and heat shield 50, when the shield is fixed to the lower bracket. Ventilation gap A is between 0.5 mm and 3 mm. In specific variations, ventilation gap A is 1.5 mm.

Compression plate 49 is disposed adjacent to compression face 42*b* and includes compression face 42*c*, dimensioned to fit on bracket compression face 42*b* of lower bracket plate 42, and a portion of compression slot 44.

Interior chimney 15 is made of borosilicate glass, or a material possessing similar thermal properties, and is similar to the variations disclosed in the prior Examples. Exterior chimney 10 is made of borosilicate glass, or a material possessing similar thermal properties, as disclosed in the prior Examples.

A plurality of shims 19 are formed of a fluorphlogopite mica-borosilicate ceramic insulation (Macor, Corning Inc., Corning, NY). Shim 19 is shaped to include finger spacers disposed on the lower face of the shim and dimensioned to hold the coils of upper heating element 5. However, shim 19 can alternatively be a rectangular spacer, as seen in FIG. 5.

Upper heating element 5 includes upper heating element electrical connector 6 disposed on the outermost coil of the heating element. Upper heating element electrical connector 6 is formed of the same material as upper heating element 5 or other electrically conductive material.

A plurality of upper spacers 20 are formed of a fluorphlogopite mica-borosilicate ceramic insulation. The spacer is formed of upper spacer top element finger spacers 21, disposed on the upper face of the upper spacer and dimensioned to hold the coils of upper heating element 5. Upper spacer bottom element finger spacers 22, disposed on the lower face of the upper spacer and dimensioned to hold the coils of lower heating element 7.

Lower heating element 7 includes lower heating element electrical connector 8 disposed on the outermost coil of the heating element. Lower heating element electrical connector 8 is formed of the same material as lower heating element 7, or other electrically conductive material.

Figure 10:
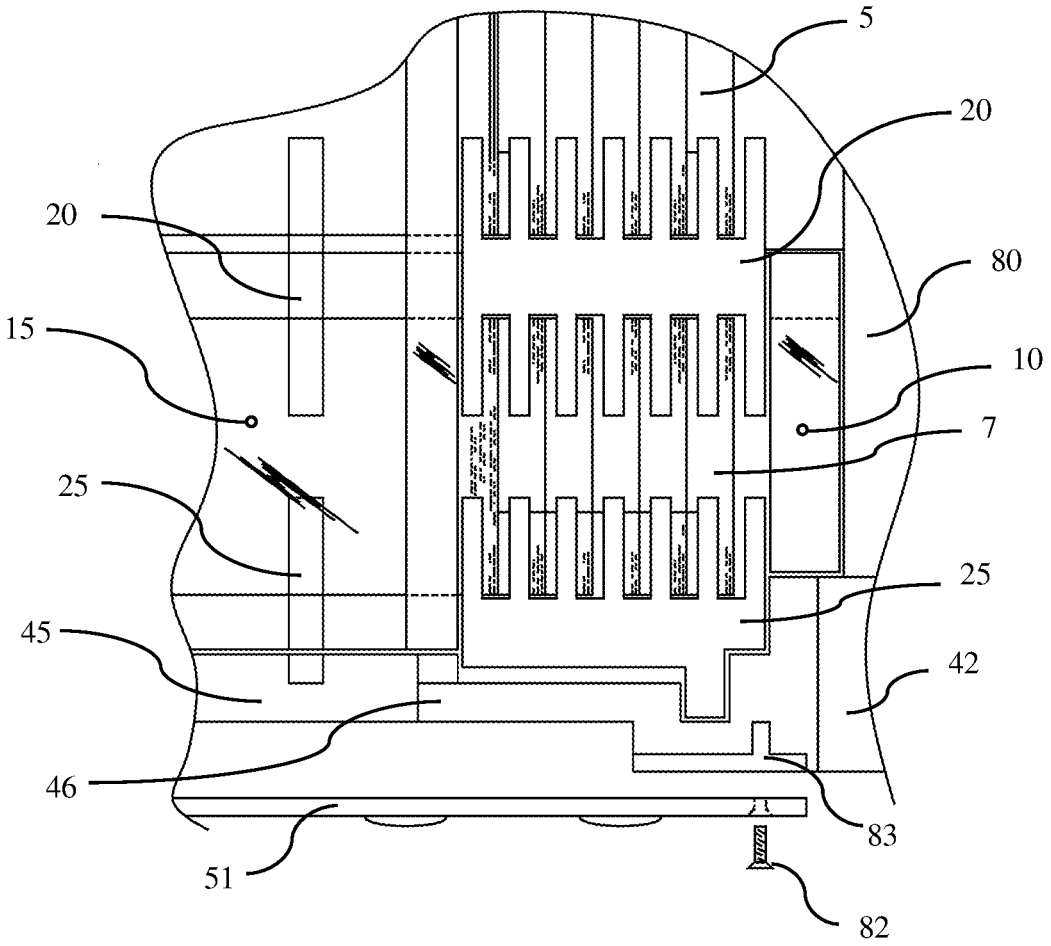
FIG. 10 is a cross-sectional, blown-up view of an embodiment of the heating element of the invention.

A plurality of lower spacers 25 are formed of a fluorphlogopite mica-borosilicate ceramic insulation. The spacer is formed of lower spacer top element spacers 26, disposed on the upper face of the lower spacer and dimensioned to hold the coils of lower heating element 7. Lower spacer shim 27 is disposed on the lower face of the lower spacer and dimensioned to fit in exterior spacer shim lip 47 of lower bracket 40, as seen in FIG. 10. In some variations, a concentric ridge is disposed adjacent to exterior spacer shim lip 47, thereby accepting the bottom portion of lower spacer shim 27, seen in FIG. 10. Similarly, a ridge may be provided in interior chimney spacer 45 to accept the inner-most portion of lower spacer 25, further locking the spacers into orientation within the lower bracket.

Heat shield 50 is formed of cast aluminum and includes heating plate 51. At least one heating plate vent 52 is disposed in heating plate 50 and extends from the top face of the heating plate to the bottom face of the plate. Heating plate vent 52 is shown as vent slot 52*a* in the heat shield, but may alternatively be a plurality of holes. A plurality of heating plate mounting points 53 are disposed on the top face of heating plate 51 and dimensioned to accept the bottom of heating plate mount 48. A plurality of holes are disclosed on heating plate 51, thereby permitting heating plate mounting screw 82 to extend through the heat shield to mounting screw hole 83.

An electrical supply (not shown) includes an electrically conductive and insulated cord that extends through electrical connector slot 43 and into an interior space made by electric supply housing 80. Coil connector mount 9 joins with upper heating element electrical connector 6 and lower heating element electrical connector 8 within the interior space of electric supply housing 80, and is in electrical communication with the electrical supply.

Example 4

Radiant heater 1 is shown similar to the prior Examples. The radiant heater assembly is prepared by placing lower spacers 25 into lower bracket 40 lower bracket 40, such that lower spacer shim 27 fits in exterior spacer shim lip 47 of lower bracket 40, shown in FIG. 10. Lower heating element 7 is fitted into lower spacer top element spacers 26 with lower heating element electrical connector 8, such that the coils of the lower heating element are fitted into discrete locations in the lower spacer top element, and oriented within electrical connector slot 43. Interior chimney 10 placed onto interior chimney spacer 45. Upper spacers 20 are placed onto lower heating element 7 such that upper spacer bottom element finger spacers 22 are fitted into the lower heating element coils. Exterior chimney 10 is placed onto lower bracket ring 41 and oriented such that the interior wall of the chimney is adjacent to the exterior faces of lower spacers 25, thereby concurrently locking the chimney into location and locking the lower spacers between the interior chimney and exterior chimney.

Upper heating element 5 is fitted into upper spacer top element finger spacers 21, such that the coils of the upper heating element are fitted into discrete locations in the upper spacer top element finger spacers, and oriented such that upper heating element electrical connector 6 is disposed adjacent to lower heating element electrical connector 8.

An electrical supply (not shown) is electrically connected to upper heating element electrical connector 6 and lower heating element electrical connector 8, and electric supply housing 80 fitted around upper heating element electrical connector 6 and lower heating element electrical connector 8 and aligned with lower bracket plate 42. The electrical wires for the electrical supply are placed adjacent to compression slot 44. Lower bracket plate mounting screw 86 is fitted into lower bracket plate mounting screw hole 87 and mounts electric supply housing 80 to lower bracket plate 42.

Figure 11:
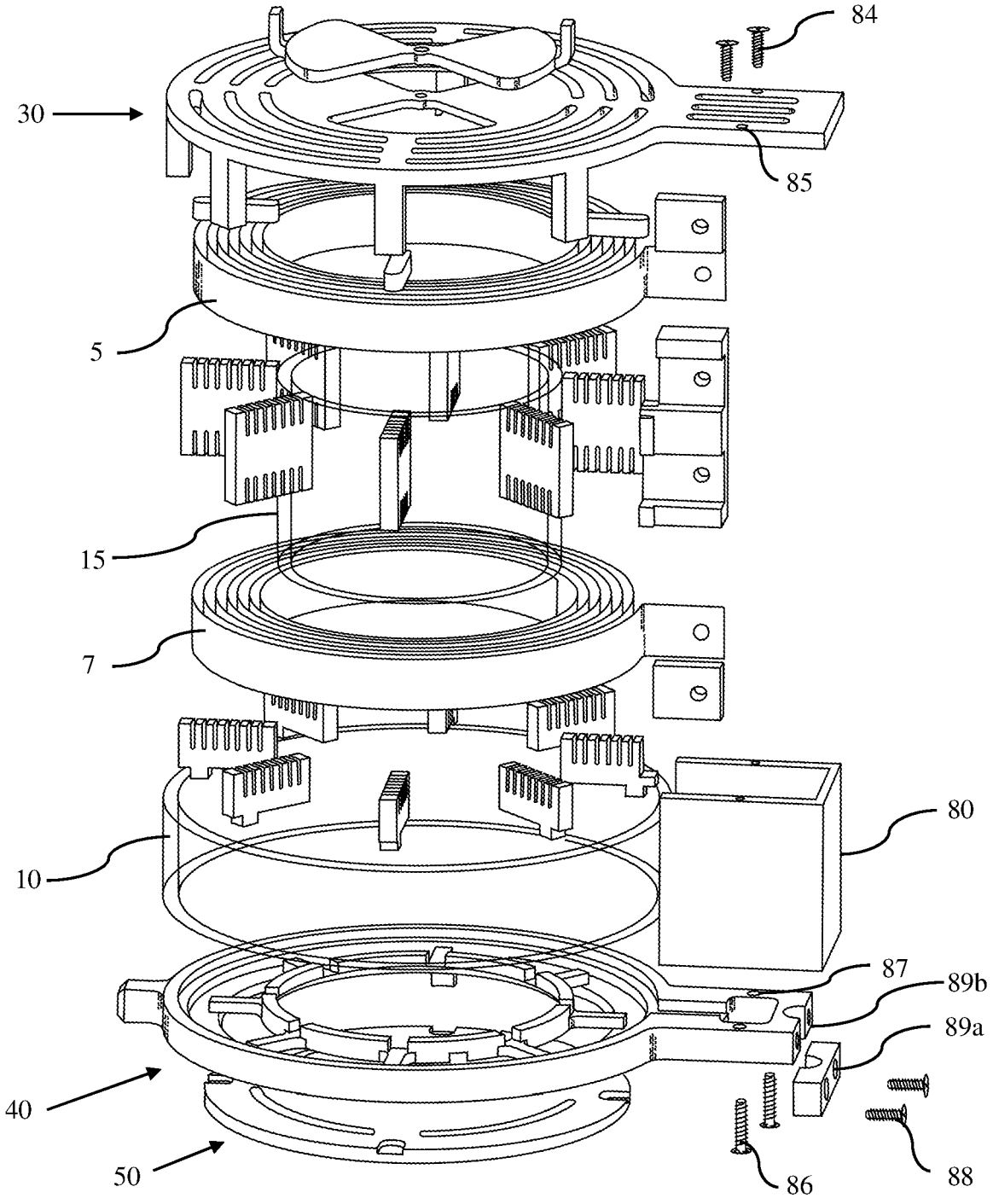
FIG. 11 is an isometric view of a breakaway view of an embodiment of the radiant heater of the invention.
Figure 12:
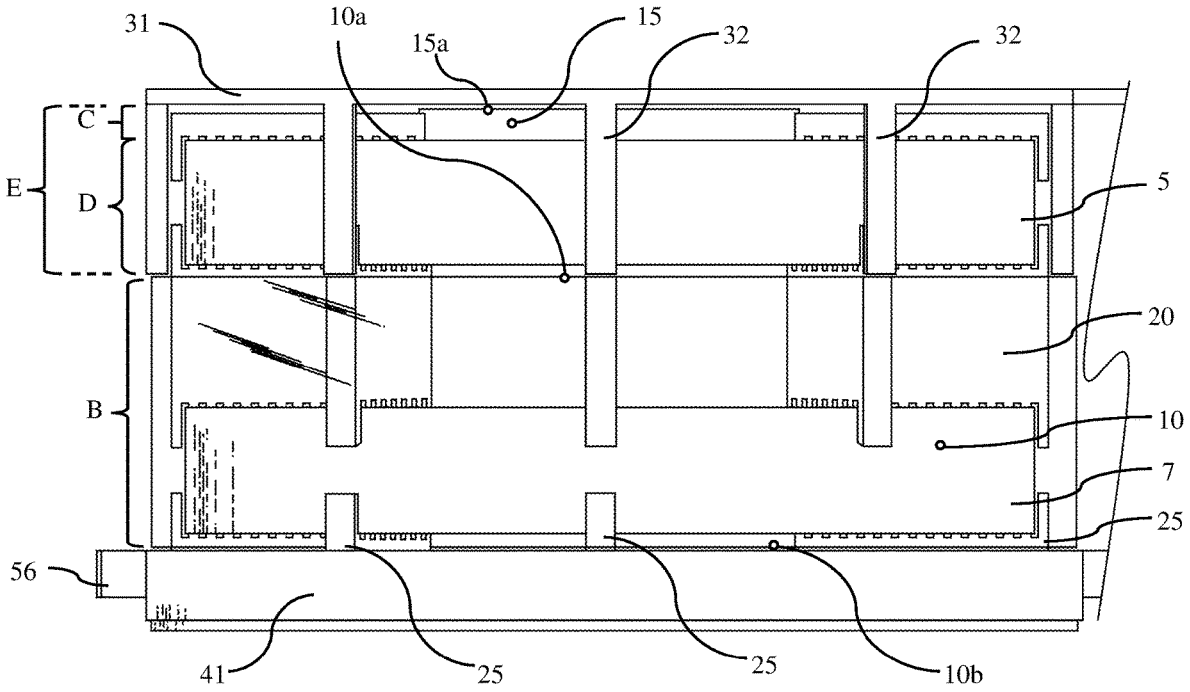
FIG. 12 is a side view of an embodiment of the radiant heater of the invention.
Figure 13A:
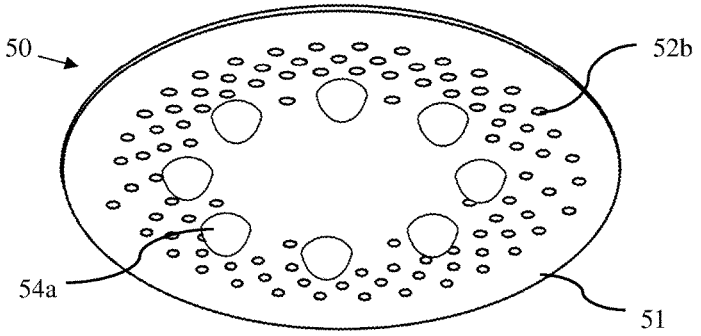
FIG. 13(*a*) is an isometric view of an embodiment of the heat shield of the radiant heater of the invention depicting semispherical projections on the lower face of the heat shield.
Figure 13B:
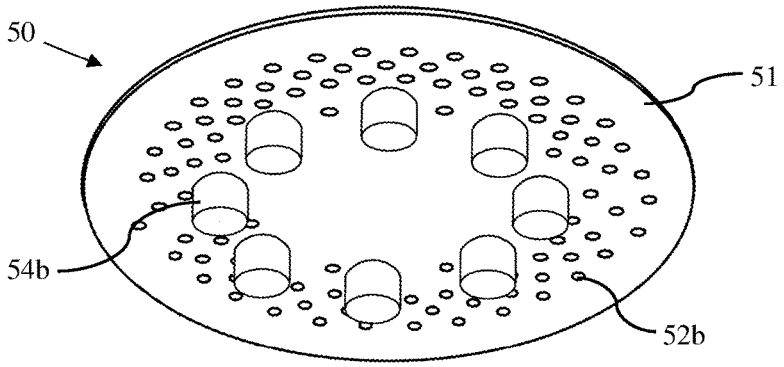
Figure 13C:
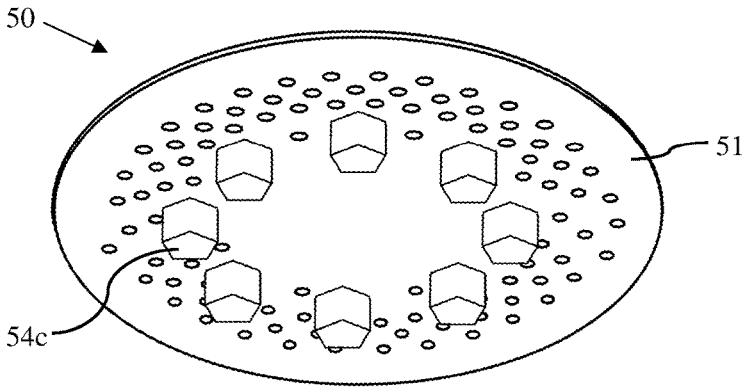
Figure 13D:
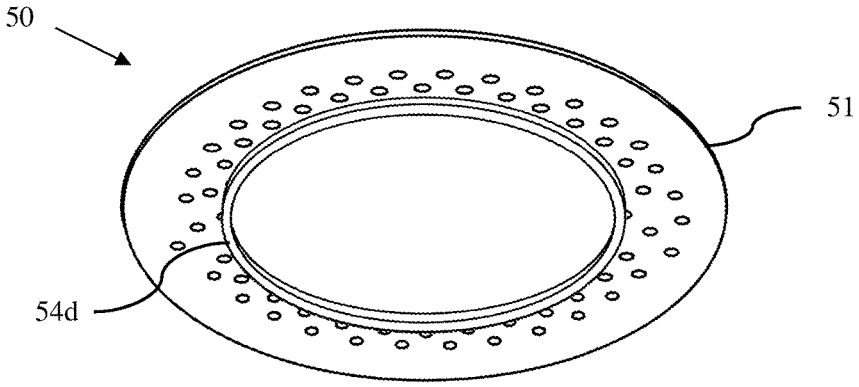
Figure 13E:
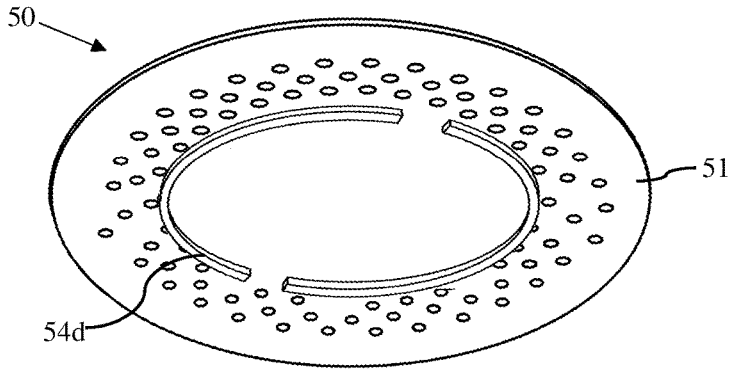
Figure 13F:
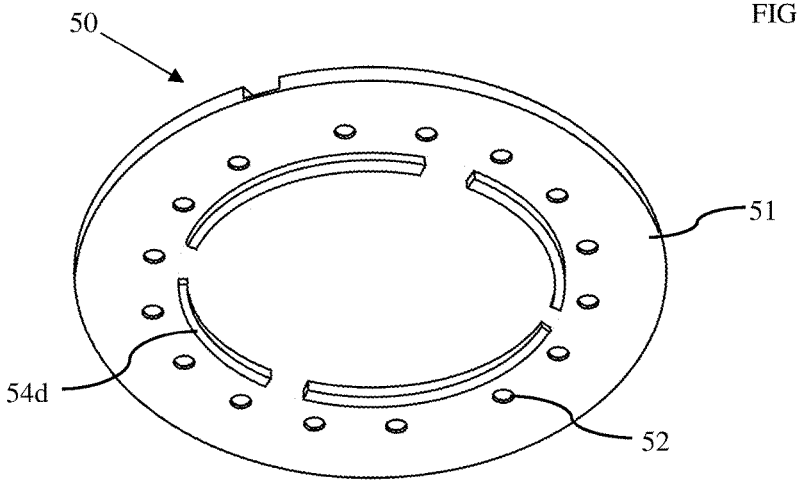
Figure 13G:
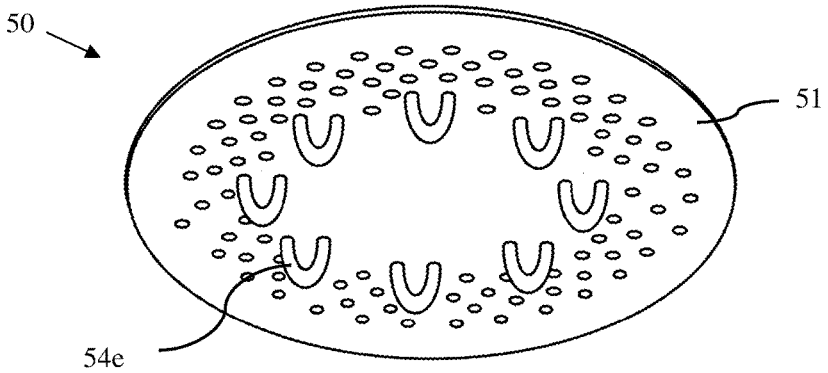
Figure 13H:
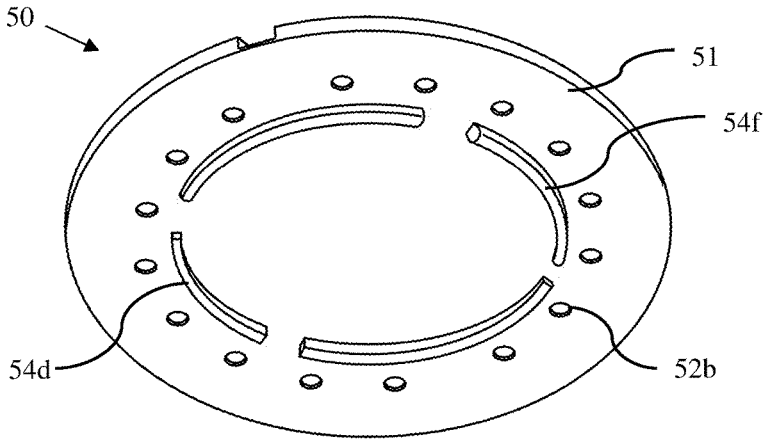

Shims 19 are placed on the upper edge of upper heating element 5, where the shim is a rectangular spacer. Alternatively, shims 19 are placed onto upper heating element 5 such that shim finger spacers are fitted into the upper heating element coils, where the shim includes spacers disposed on the lower face of the shim, as seen in FIGS. 11 and 12, respectively.

Upper bracket 30 is placed onto shims 19 such that the upper face of shim 19 fits into ring upper spacer mount 38, and upper bracket plate 33 aligns above lower bracket plate 42. Upper ring mounts 32 circumscribe upper heating element 5 and sit on exterior chimney upper edge 10*a*. Upper bracket plate mounting screw 84 is fitted into upper bracket plate mounting screw hole 85 and mounts electric supply housing 80 to upper bracket 30.

Compression plate 49 is placed on the end of lower bracket plate 42, such that bracket compression face 42*b* is fitted against compression face 42*c* of the compression plate. Compression plate mounting screw 88 is fitted through compression plate mounting screw hole 89*a* of compression plate 49 and into compression mounting screw hole 89*b* of lower bracket plate 42, thereby fixing compression plate 49 to lower bracket plate 42 and establishing compression slot 44. The electrical wires of the electrical power source and positioned within compression slot 44.

Heat shield 50 is aligned with lower bracket 40, such that heating plate mount 48 fits within, or partially within, heating plate mounting point 53. The assembly may be defined by regions having a specified height. Height B is defined as the distance between exterior chimney upper edge 10*a* and exterior chimney lower edge 10*b*, seen in FIG. 12, and is 18 mm in some embodiments. Height B extends from the upper face of lower bracket 40 to substantially at the lower edge of the upper heating element. Height E is the exposed spacing, between exterior chimney upper edge 10*a* and the lower edge of upper bracket ring 31, and includes heights C and D. Height C is defined as the distance between the upper edge of the upper heating element and the lower face of the upper bracket, and is 2.2 mm in certain embodiments. Height D is defined as the distance from exterior chimney upper edge 10*a* to the upper edge of the upper heating element. In this embodiment, height D is 10.7 mm. Height D is the thickness of the upper heating element, and optionally includes substantially the thickness of the upper heating element, i.e. may include the upper heating element and a portion of upper spacer 20 that overlaps the heating element, as seen in FIG. 12.

The assembly can be placed onto a hookah head for use.

Example 5

The assembly is formed as described in Example 4. In this variation, the assembly includes height B is defined as the distance between exterior chimney upper edge 10*a* and exterior chimney lower edge 10*b*, seen in FIG. 12. Height B extends from the upper face of lower bracket 40 to the halfway distance between the upper heating element and the lower heating element. Height E is the exposed spacing, between exterior chimney upper edge 10*a* and the lower edge of upper bracket ring 31, and includes height C and D. Height C is defined as the distance between the upper edge of the upper heating element and the lower face of the upper bracket. Height D is defined as the distance from exterior chimney upper edge 10*a* to the upper edge of the upper heating element. In this variation, height E is 12.9 mm. Height D is the thickness of the upper heating element, and includes a substantial portion of upper spacer 20, typically about one half the thickness of the upper spacer.

Example 6

The assembly is formed as described in Example 4. In this variation, the assembly includes height B is defined as the distance between exterior chimney upper edge 10*a* and exterior chimney lower edge 10*b*, seen in FIG. 12. Height B extends from the upper face of lower bracket 40 to the middle of the upper heating element. Height E is the exposed spacing, between exterior chimney upper edge 10*a* and the lower edge of upper bracket ring 31, and includes height C and D. Height C is defined as the distance between the upper edge of the upper heating element and the lower face of the upper bracket. Height D is defined as the distance from exterior chimney upper edge 10*a* to the upper edge of the upper heating element. In this variation, height D is about one half the thickness of the upper heating element.

Example 7

Radiant heater 1 is shown similar to the prior Examples. The radiant heater assembly is prepared by placing lower spacers 25 into lower bracket 40 lower bracket 40, such that lower spacer shim 27 fits in exterior spacer shim lip 47 of lower bracket 40, shown in FIG. 11. Lower heating element 7 is fitted into lower spacer top element spacers 26 with lower heating element electrical connector 8, such that the coils of the lower heating element are fitted into discrete locations in the lower spacer top element, and oriented within electrical connector slot 43. Interior chimney 10 placed onto interior chimney spacer 45. Upper spacers 20 are placed onto lower heating element 7 such that upper spacer bottom element finger spacers 22 are fitted into the lower heating element coils. Exterior chimney 10 is placed onto lower bracket ring 41 and oriented such that the interior wall of the chimney is adjacent to the exterior faces of lower spacers 25, thereby concurrently locking the chimney into location and locking the lower spacers between the interior chimney and exterior chimney.

Upper heating element 5 is fitted into upper spacer top element finger spacers 21, such that the coils of the upper heating element are fitted into discrete locations in the upper spacer top element finger spacers, and oriented such that upper heating element electrical connector 6 is disposed adjacent to lower heating element electrical connector 8.

An electrical supply (not shown) is electrically connected to upper heating element electrical connector 6 and lower heating element electrical connector 8, and electric supply housing 80 fitted around upper heating element electrical connector 6 and lower heating element electrical connector 8 and aligned with lower bracket plate 42. The electrical wires for the electrical supply are placed adjacent to compression slot 44. Lower bracket plate mounting screw 86 is fitted into lower bracket plate mounting screw hole 87 and mounts electric supply housing 80 to lower bracket plate 42.

Shims 19 are placed on the upper edge of upper heating element 5, where the shim is a rectangular spacer. Alternatively, shims 19 are placed onto upper heating element 5 such that shim finger spacers are fitted into the upper heating element coils, where the shim includes spacers disposed on the lower face of the shim, as seen in FIGS. 11 and 12, respectively.

Upper bracket 30 is placed onto shims 19 such that the upper face of shim 19 fits into ring upper spacer mount 38, and upper bracket plate 33 aligns above lower bracket plate 42. Upper ring mounts 32 circumscribe upper heating element 5 and sit on exterior chimney upper edge 10*a*. Upper bracket plate mounting screw 84 is fitted into upper bracket plate mounting screw hole 85 and mounts electric supply housing 80 to upper bracket 30.

Compression plate 49 is placed on the end of lower bracket plate 42, such that bracket compression face 42*b* is fitted against compression face 42*c* of the compression plate. Compression plate mounting screw 88 is fitted through compression plate mounting screw hole 89*a* of compression plate 49 and into compression mounting screw hole 89*b* of lower bracket plate 42, thereby fixing compression plate 49 to lower bracket plate 42 and establishing compression slot 44. The electrical wires of the electrical power source and positioned within compression slot 44.

Heat shield 50 is aligned with lower bracket 40, such that heating plate screw mounting locations align with include mounting screw hole 83, as seen in FIG. 12. For example, heating plate 50 optionally includes shield mount hole 83*a*, disposed and dimensioned to align with mounting screw hole 83 on lower bracket 40. In some variations, heating plate mount 48 includes mounting screw hole 83 and assists in aligning the heat shield using the heating plate mount 48 and heating plate mounting point 53. After alignment of the heating plate to the lower bracket, heating plate mounting screw 82 mounts heat shield 50 to lower bracket 40. The mounting of heating plate 50 retains ventilation gap A.

The assembly may be defined by regions having a specified height, i.e. heights B, E, C and D. Heights B, E, C and D are defined as provided in Examples 4, 5, or 6, based on the respective variation disclosed in those Examples.

Example 8

Heat shield 50 includes heating plate 51 and a plurality of heating plate vents 52. In the illustrative embodiment, heating plate vent 52 is depicted as vent holes 52*b*, disposed through heating plate 51, as seen in FIG. 13(*a*), though vent slot 52*a* can be used instead. A plurality of heating projections 54 are shown as semispherical projection 54*a*. The semispherical projections are optionally disposed equidistant along an interior portion of the heating plate body, permitting the radiant heater to further heat the tobacco and provide a mounting point for the radiant heater to attach to the hookah.

In another variation, heat shield 50 includes a plurality of vent holes 52*b* through heating plate 51 and cylindrical projections 54*b*, as seen in FIG. 13(*b*). The cylindrical projections are optionally disposed equidistant along an interior portion of the heating plate body. In alternative variations, vent slots 52*a* are disposed through heating plate 51. As with prior Examples, the interaction between heating plate mount 48 and heating plate mounting point 53 form ventilation gap A between lower bracket 40 and heat shield 50.

In an alternative variation, heat shield 50 includes a plurality of vent holes 52*b* through heating plate 51 and polygonal projections 54*c*, as seen in FIG. 13(*c*). The cylindrical projections are optionally disposed equidistant along an interior portion of the heating plate body. In alternative variations, vent slots 52*a* are disposed through heating plate 51. As with prior Examples, the interaction between heating plate mount 48 and heating plate mounting point 53 form ventilation gap A between lower bracket 40 and heat shield 50.

In an alternative variation, heat shield 50 includes a plurality of vent holes 52*b* through heating plate 51 and channel projection 54*d*, seen in FIG. 13(*d*). Channel projection 54*d* is optionally a single, circular channel. Alternatively, channel projection 54*d* is an arc-shaped channel having two projections, as seen in FIG. 13(*e*), or multiple projections, as seen in FIG. 13(*f*). As with prior Examples, the interaction between heating plate mount 48 and heating plate mounting point 53 form ventilation gap A between lower bracket 40 and heat shield 50.

In an alternative variation, heat shield 50 includes a plurality of vent holes 52*b* through heating plate 51 and arc-shaped projection 54*e*, seen in FIG. 13(*g*). Arc-shaped projection 54*e* is optionally a single, circular channel. Channel projections 54*d* are optionally disposed equidistant along an interior portion of the heating plate body. In alternative variations, vent slots 52*a* are disposed through heating plate 51. As with prior Examples, the interaction between heating plate mount 48 and heating plate mounting point 53 form ventilation gap A between lower bracket 40 and heat shield 50.

In an alternative variation, heat shield 50 includes a plurality of vent holes 52*b* through heating plate 51 and channel projection 54*d* and tubular channel projection 54*f*, seen in FIG. 13(*h*). Tubular channel projection 54*f* is optionally a single, circular channel, or a plurality of channels. The projections can also include different embodiments of the projections, such as channel projection 54*d* and tubular channel projection 54*f* depicted in the illustrative drawing. The channel projections are optionally disposed equidistant along an interior portion of the heating plate body. In alternative variations, vent slots 52*a* are disposed through heating plate 51. As with prior Examples, the interaction between heating plate mount 48 and heating plate mounting point 53 form ventilation gap A between lower bracket 40 and heat shield 50.

Example 9

Radiant heater 1 is shown similar to the prior Examples, using a unique heat shield. The radiant heater assembly is prepared by placing lower spacers 25 into lower bracket 40 lower bracket 40, such that lower spacer shim 27 fits in exterior spacer shim lip 47 of lower bracket 40, shown in FIG. 14(*a*). Lower heating element 7 is fitted into lower spacer top element spacers 26 with lower heating element electrical connector 8, such that the coils of the lower heating element are fitted into discrete locations in the lower spacer top element, and oriented within electrical connector slot 43. Interior chimney 10 placed onto interior chimney spacer 45. Upper spacers 20 are placed onto lower heating element 7 such that upper spacer bottom element finger spacers 22 are fitted into the lower heating element coils. Exterior chimney 10 is placed onto lower bracket ring 41 and oriented such that the interior wall of the chimney is adjacent to the exterior faces of lower spacers 25, thereby concurrently locking the chimney into location and locking the lower spacers between the interior chimney and exterior chimney.

Upper heating element 5 is fitted into upper spacer top element finger spacers 21, such that the coils of the upper heating element are fitted into discrete locations in the upper spacer top element finger spacers, and oriented such that upper heating element electrical connector 6 is disposed adjacent to lower heating element electrical connector 8.

An electrical supply (not shown) is electrically connected to upper heating element electrical connector 6 and lower heating element electrical connector 8, and electric supply housing 80 fitted around upper heating element electrical connector 6 and lower heating element electrical connector 8 and aligned with lower bracket plate 42. The electrical wires for the electrical supply are placed adjacent to compression slot 44. Lower bracket plate mounting screw 86 is fitted into lower bracket plate mounting screw hole 87 and mounts electric supply housing 80 to lower bracket plate 42.

Shims 19 are placed on the upper edge of upper heating element 5, where the shim is a rectangular spacer. Alternatively, shims 19 are placed onto upper heating element 5 such that shim finger spacers are fitted into the upper heating element coils, where the shim includes spacers disposed on the lower face of the shim, as discussed in the prior Examples.

Upper bracket 30 is placed onto shims 19 such that the upper face of shim 19 fits into ring upper spacer mount 38, and upper bracket plate 33 aligns above lower bracket plate 42. Upper ring mounts 32 circumscribe upper heating element 5 and sit on exterior chimney upper edge 10*a*. Upper bracket plate mounting screw 84 is fitted into upper bracket plate mounting screw hole 85 and mounts electric supply housing 80 to upper bracket 30.

Compression plate 49 is placed on the end of lower bracket plate 42, such that bracket compression face 42*b* is fitted against compression face 42*c* of the compression plate. Compression plate mounting screw 88 is fitted through compression plate mounting screw hole 89*a* of compression plate 49 and into compression mounting screw hole 89*b* of lower bracket plate 42, thereby fixing compression plate 49 to lower bracket plate 42 and establishing compression slot 44. The electrical wires of the electrical power source and positioned within compression slot 44.

Figure 14A:
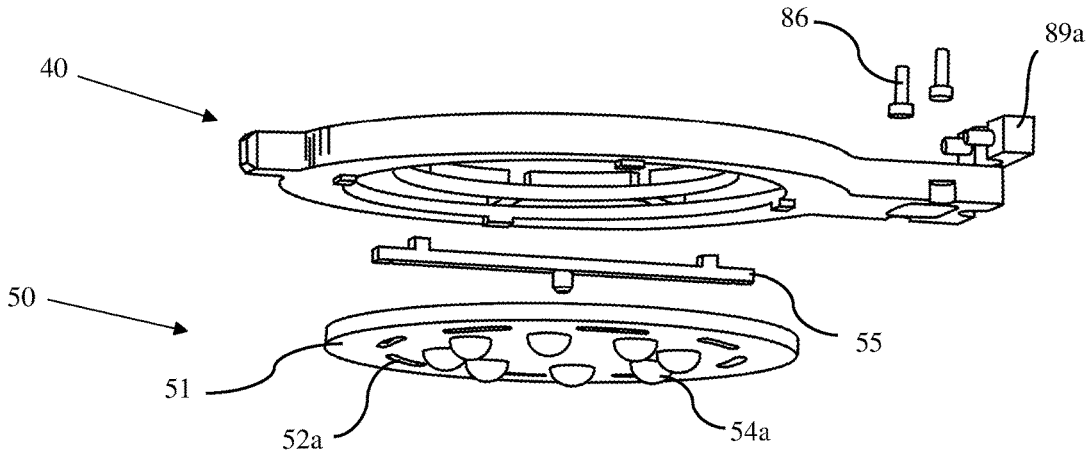
FIG. 14(*a*) is an isometric view of an embodiment of the heat shield and lower bracket of an embodiment of the radiant heater of the invention.
Figure 14B:
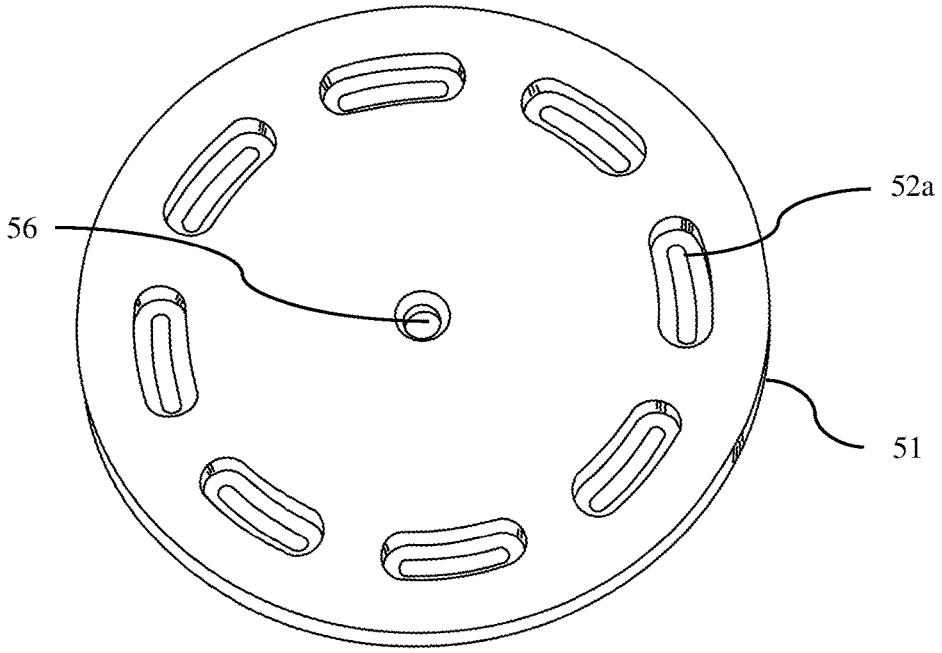

Heat shield 50 includes vent slot 52*a* and projections 54, which can be any projections seen in the prior Examples. In the illustrative example, the projections are one or more semispherical projection 54*a*, as seen in FIG. 14(*b*). Heat shield 50 is optionally connected to shield bracket 55 by shield mount 56, disposed on the upper face of the heat shield. The heat shield and shield bracket are aligned with lower bracket 40, such that shield bracket aligns with include mounting points on the lower bracket. The mounting of heating plate 50 retains ventilation gap A.

Example 10

Figure 15:
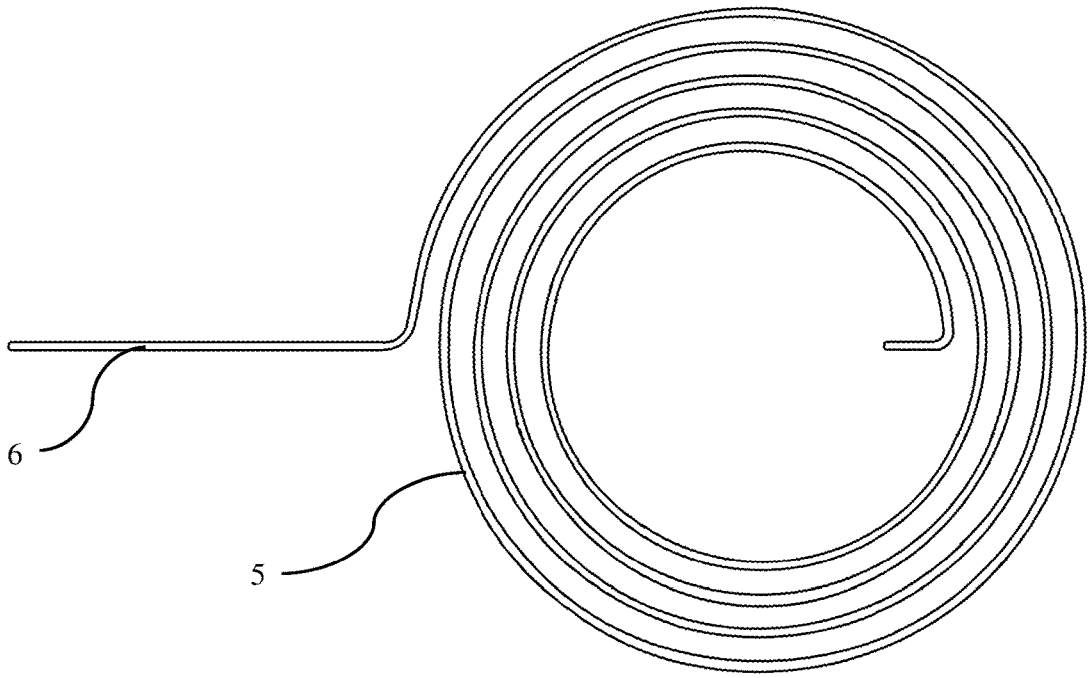
FIG. 15 is a top down view of an embodiment of a heating element of the invention.

The heating elements are formed of heating coils. In the illustrative drawing, upper heating element 5 and upper heating element electrical connector 6 are formed of NiCr resistive wire ribbon, with a content of nickel (80%) to chromium (20%). The coils are wrapped in a circular fashion, as seen in FIG. 15. The outermost coil of upper heating element 5 terminates in upper heating element connector 6, a straight section of resistive wire ribbon. Upper heating element connector 6 is dimensioned to reach the interior space made by electric supply housing 80 and contact coil connector mount 9, coil electrical connector 99, or upper heating coil output connector 94. Coil electrical connector 99 is shaped similarly to coil connector mount 9 and is formed of electrically conductive material, such as NiCr alloy. It is to be appreciated by one of skill in the art that lower heating element 7 is formed similarly to upper heating element 5.

Figure 16:
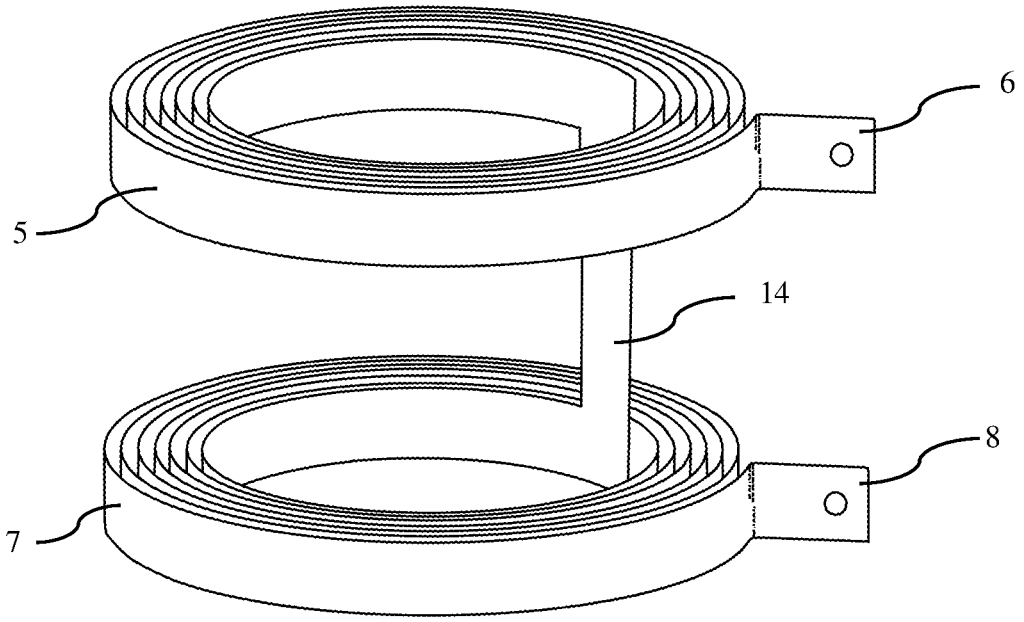
FIG. 16 is an isometric view of an embodiment of a heating element of the invention.

In one variation of the invention, the innermost coil of upper heating element 5 makes a 90 degree turn to form coil link 14. Coil link 14 extends to the innermost coil of lower heating coil 7, as seen in FIG. 16. In this variation, the electrical connections required by the power supply are minimized.

Figure 17:
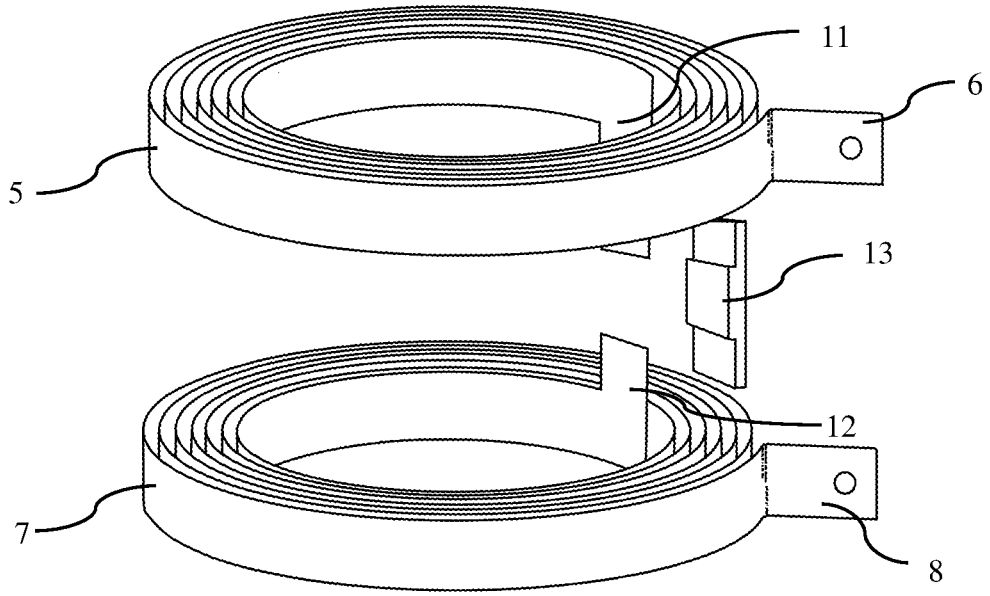
FIG. 17 is an isometric view of an embodiment of a heating element of the invention.

In a second variation, the innermost coil of upper heating coil 5 makes a 90 degree turn to form upper interior coil connector 11. The innermost coil of lower heating coil 7 makes a 90 degree turn to form lower interior coil connector 12. Interior coil link 13 is formed of electrically conductive material and is dimensioned to accept lower interior coil connector 12 on an upper end and upper interior coil connector 11 on a lower end of interior coil link 13, as seen in FIG. 17. This variation of the coils minimizes the electrical connections required by the power supply.

Figure 18:
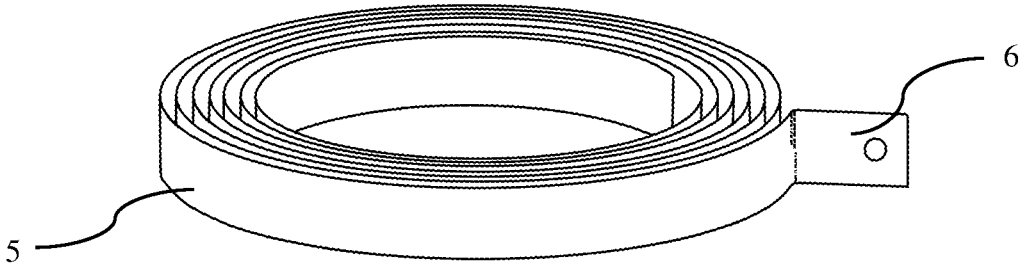
FIG. 18 is an isometric view of an embodiment of a heating element of the invention.

In a third variation, the innermost coil of upper heating coil 5 terminates in a coil, i.e. the ribbon is not bent at an angle, as seen in FIG. 18. Similarly, the innermost coil of lower heating coil 7 terminates without being bent. In this variation, upper heating coil 5 and lower heating coil 7 are not interiorly connected, and each coil can be independently heated, as each coil requires separate electrical connections.

Example 11

Figure 19:
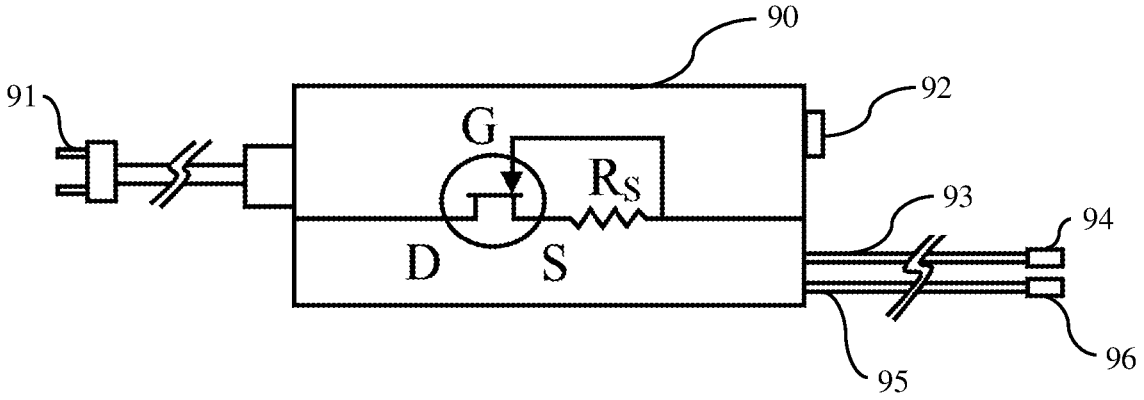
FIG. 19 is a diagram of a power supply for an embodiment of the invention.

Power supply 90 is a dual output current regulated system that is dimmable, as seen in FIG. 19. Power supply 90 includes power supply input 91, such as a standard power plug capable of accepting 100-277 VAC. Current adjustment 92 is disposed on power supply 90 and can alter current between 0 and 100 kΩ in a first channel and between 0 and 100 kΩ in a second channel, resulting in a power current of 10.5 Amps to 13.5 Amps for the first channel (maximum of 23V) and 5 Amps and 8 Amps for the second channel (maximum of 11V). Upper heating coil output 93 is in electrical communication with the second channel and exits power supply 90 and includes +11V in pin 1 and 0V in pin 2. Upper heating coil output 93 terminates in upper heating coil output connector 94, which connects to upper heating element connector 6. Lower heating coil output 95 is in electrical communication with the first channel and exits power supply 90 and includes +23V in pin 1 and 0V in pin 2. Lower heating coil output 95 terminates in lower heating coil output connector 96, which connects to lower heating coil connector 8. Alternatively, power supply 90 can be voltage-regulated, using Ohm's law.

In variations where upper heating element 5 and lower heating coil 7 are interiorly connected, allowing the two coils to form a circuit, power supply 90 includes only one heating coil output. In this variation, power supply 90 has only one channel and the heating coil output is in electrical communication with the channel and includes +11V in pin 1 and 0V. The heating coil output terminates in a heating coil output connector, which connects to upper heating element connector 6 and lower heating element connector 8, which are connected to the electrically insulated coil connector mount 9.

Example 12

Figure 20:
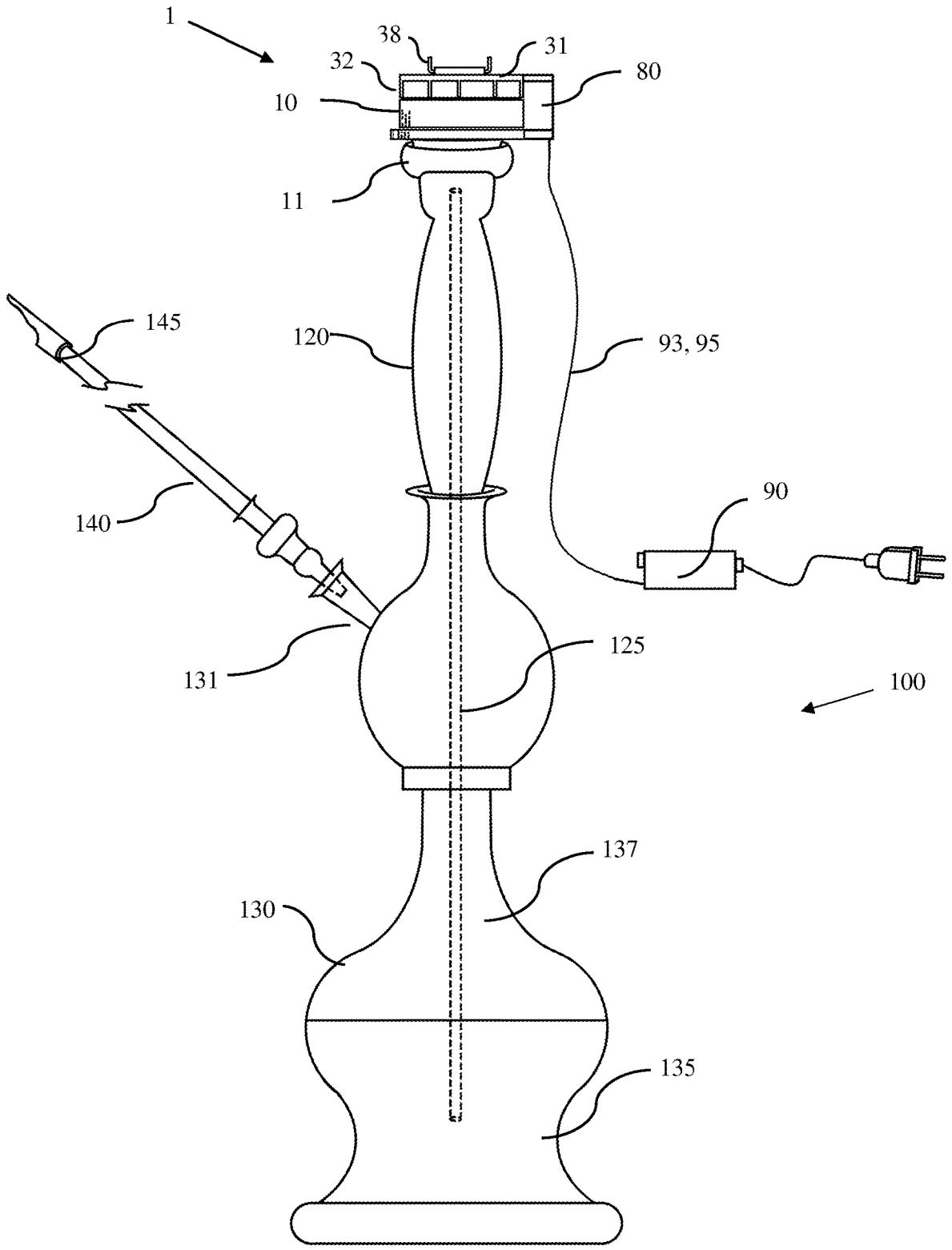
FIG. 20 is a cut away view of a hookah with an embodiment of the invention attached to the head.

Hookah 100 is prepared for use as commonly known in the art, with vase 130 comprising water 135 with head space 137 immediately above water 135, seen in FIG. 20. Hose 140 connects to vase 130 at port 131 via a first end and thereby directly accesses dead space 137. Mouthpiece 145 connects to a second end of hose 140. Body 120 is mounted onto vase 130, such that channel 125, located in the interior of body 120 is positioned to enable the lower end of the channel to submerge in water 135. The lower portion of body 120 forms a seal with an upper opening in vase 130. Head 110 is mounted to the upper portion of body 120 and in fluid communication with channel 125. Head 110 is made of a material capable of withstanding temperatures needed to vaporize the combustible material, such as glass, ceramic, or steel. Tobacco or other combustible material is placed in head 110.

Radiant heater 1 is assembled as described in previous Examples, and placed on top of head 110, as seen in FIG. 20. The upper section of radiant heater 1 defined by height E is not covered, allowing heat to escape and cool air to be drawn past the heating elements. Further, upper heating bracket vent 35 allows additional heat to escape and cool air to be drawn past the heating elements. Upper heating opening 36 is in fluid communication with the interior of inner chimney 15 and permits cool air to be drawn through the interior of the radiant heater, bypassing the heating elements. Testing showed this design permits partial covering of the upper surface of the heating element, providing increased safety to a user from burns, while concurrently preventing overly high temperatures that burned the combustible material, i.e. tobacco, as noted above.

The radiant heater is connected to an electrical source providing about 10-24V and a current of about 5 to 15 Amperes and the heater elements warmed up. Electrical current causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation gap between the heat shield and lower bracket, and from the interior of the inner chimney. The heated air and cool air mixed just above the heat shield. The mixed air is drawn through the plurality of vents and into the tobacco, heating the glycerin and aromatic oils in the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

Example 13

Figure 21:
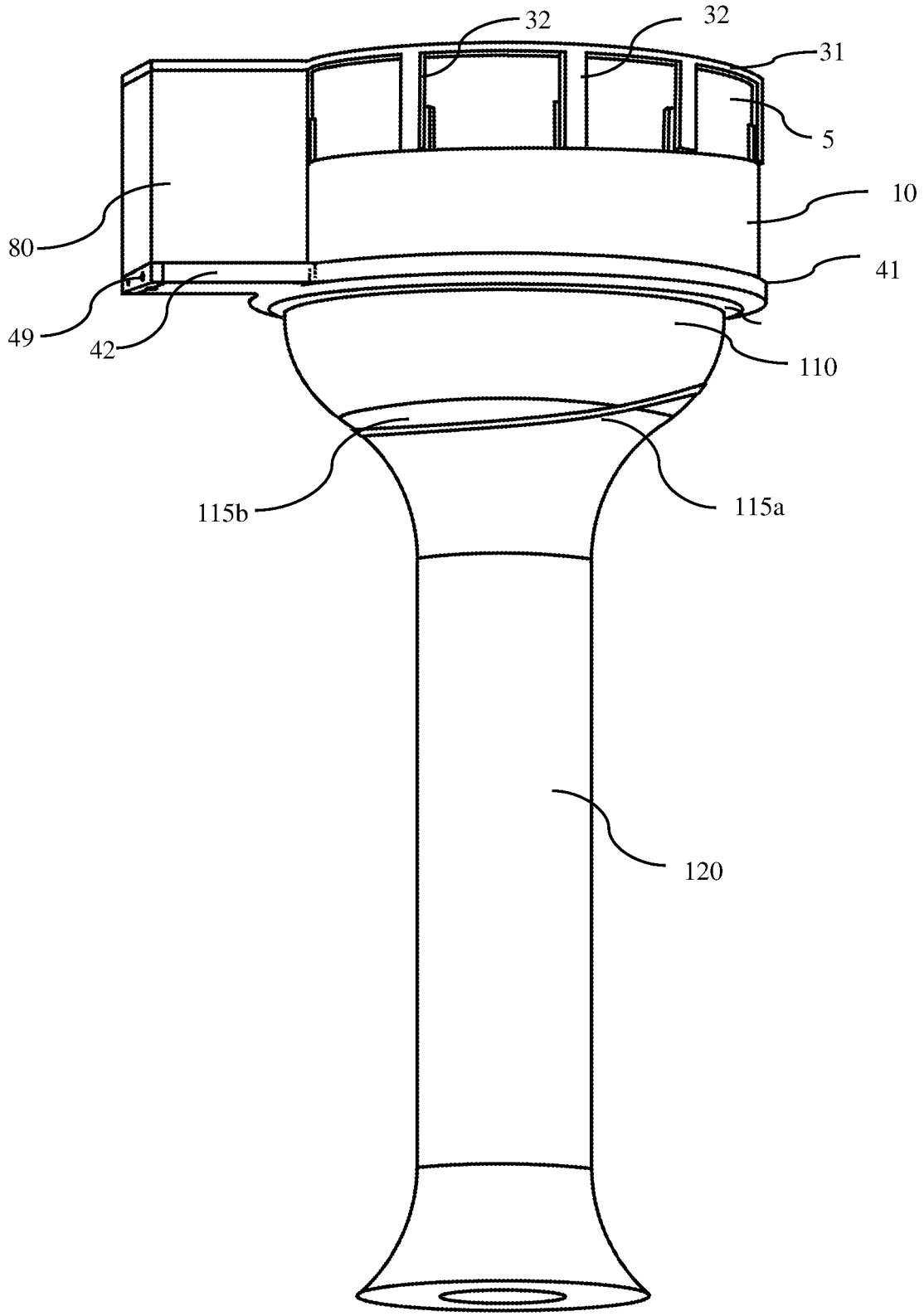
FIG. 21 is an isometric view of the inventive heater attached to a hookah head using silicon rubber bands.

Radiant heater 1 was assembled as described in the prior Examples. Radiant heater 1 is placed on head 110, and one silicon rubber band, also known as cooking rubber band, is attached to lower ring mount 56, such that the rubber bands traverse the lower flair of head 110, as seen in FIG. 21, thereby securing heat shield 50 to head 110, along with radiant heater 1.

The radiant heater is connected to an electrical source providing about 10V to about 25 V and a current of about 4 Amperes to about 25 Amperes and the heater elements warmed up. Electrical current is then applied, causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation gap between the heat shield and lower bracket, and from the interior of the inner chimney. The heated air and cool air mixed just above the heat shield. When not in use, air is siphoned through the interior of the interior chimney toward the heat shield, transferring the heat away from the tobacco. When used, the mixed air is drawn through the plurality of vents and into the tobacco, heating the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosure of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall therebetween.

What is claimed is:

1. A radiant heating system, comprising:

a heating element, wherein the heating element comprises:

at least one heating coil comprising resistance wire;

a heating element electrical connector formed of electrically conductive material and disposed on the exterior end of the at least one heating coil;

an exterior chimney having an interior space defined by at least one wall and dimensioned to accept the at least one heating element to substantially enclose the at least one heating element within the interior space;

an interior chimney having an exterior wall, wherein the exterior wall is circumscribed by the heating element;

an upper bracket, further comprising:

an upper bracket ring or upper bracket plate, wherein the upper bracket ring or upper bracket plate comprises an exterior edge face, an upper face, and a lower face;

at least one heat vent disposed through the upper bracket ring or upper bracket plate and oriented such that the least one heat vent is above the heating element when the radiant heating system is assembled;

at least one cool air vent disposed through the upper bracket ring or upper bracket plate interior to the at least one heat vent and oriented such that the least one cool air vent is above the interior space of the interior chimney;

a lower bracket, further comprising:

a lower bracket ring or lower bracket plate;

an exterior chimney support disposed on an upper face of the lower bracket ring or lower bracket plate;

an interior chimney support disposed on an upper face of the lower bracket ring or lower bracket plate and interior to the exterior chimney support;

at least one opening disposed through the lower bracket ring or lower bracket plate; and at least one ventilation gap disposed above the at least one opening disposed through the lower bracket ring or lower bracket plate, wherein the ventilation gap is between about 0.5 mm and about 3 mm.

2. The radiant heating system of claim 1, wherein the lower bracket comprises a lower bracket ring, and wherein the lower bracket further comprises:

a plurality of lower ring spacer mounts comprising a bar or tube having a first end and a second end;

where the first end of the lower ring spacer mount is disposed on the interior of the lower bracket ring;

where the second end of the lower ring spacer mount is disposed on the interior chimney support;

a plurality of lower ring spacer mounts disposed on a lower face of the lower bracket, wherein the plurality of lower ring spacer mounts define the at least one ventilation gap.

3. The radiant heating system of claim 2, further comprising a heating plate disposed below the lower bracket, wherein the heating plate further comprises:

a heating plate body, having an upper face and a lower face; and a heating plate vent disposed through the heating plate body.

4. The radiant heating system of claim 3, further comprising at least one heating plate mounting point disposed on the upper face of the heating plate body or disposed through the heating plate body.

5. The radiant heating system of claim 3, further comprising at least one heating projection disposed on the lower face of the heating plate body.

6. The radiant heating system of claim 3, further comprising a shield bracket, wherein the shield bracket comprises a longitudinal bar, a mounting point disposed at about the midpoint of the longitudinal bar, and a bracket.

7. The radiant heating system of claim 2, further comprising at least one upper spacer and at least one lower spacer;

wherein the at least one upper spacer further comprises:

an upper spacer body formed of a thermal insulated material, wherein the upper spacer body comprises:

a lower face and an upper face;

where the upper face of the upper spacer body is dimensioned to fit into a slot in the lower face of the upper bracket;

wherein the at least one lower spacer further comprises:

a lower spacer body formed of a thermal insulated material, wherein the lower spacer body comprises:

a lower face and an upper face; and at least one insulated bracket finger disposed on the upper face of the lower spacer.

8. The radiant heating system of claim 6, further comprising at least one bracket finger disposed on the lower face of the at least one upper spacer.

9. The radiant heating system of claim 6, further comprising a shim disposed on the lower face of the at least one lower spacer; and a shim channel disposed in the lower bracket, where the shim channel is disposed interior to the exterior chimney support and dimensioned to accept the shim disposed on the lower face of the at least one lower spacer, a lower insulated bracket having an upper edge and a lower edge, and dimensioned to fit into the lower opening.

10. The radiant heating system of claim 1, wherein the heating element comprises a plurality of heating coils, wherein the plurality of heating coils further comprise:

an upper heating coil comprising a resistive ribbon having a first end and a second end where the first end of the upper heating coil is circumscribed by the upper heating coil and the second end of the upper heating coil extends from a coil in the upper heating coil to form an upper heating element electrical connector; and a lower heating coil comprising a resistive ribbon having a first end and a second end where the first end of the lower heating coil is circumscribed by the lower heating coil and the second end of the lower heating coil extends from a coil in the lower heating coil to form a lower heating element electrical connector.

11. The radiant heating system of claim 9, further comprising an interior coil link or interior coil connector, wherein interior coil link comprises:

an electrically conductive material disposed 90 degrees to the upper heating coil and in electrical communication with the upper heating coil and disposed 90 degrees to the lower heating coil and in electrical communication with the lower heating coil;

wherein interior coil connector comprises:

an upper interior coil connector formed of an electrically conductive material disposed 90 degrees to the upper heating coil and in electrical communication with the upper heating coil;

a lower interior coil connector formed of an electrically conductive material disposed 90 degrees to the lower heating coil and in electrical communication with the lower heating coil;

an interior coil link formed of electrically conductive material and dimensioned to accept the upper interior coil connector and the lower interior coil connector.

12. The radiant heating system of claim 9, further comprising at least one middle spacer comprising:

a middle spacer body formed of a thermal insulated material, wherein the upper spacer body comprises:

a lower face and an upper face;

at least one insulated bracket finger disposed on the upper face of the middle spacer; and at least one insulated bracket finger disposed on the lower face of the middle spacer.

13. The radiant heating system of claim 1, further comprising a butterfly air valve disposed above the at least one cool air vent;

wherein the butterfly air valve further comprises:

a cover plate dimensioned to close or partially close the at least one cool air vent;

at least one handle disposed on the cover plate; and a pivot point disposed on the cover plate and adapted to permit the butterfly valve to move from a first open position to at least a second closed position or partially closed position.

14. The radiant heating system of claim 1, further comprising a current-regulated electrical source in an electrical communication with the at least one heating element.

15. The radiant heating system of claim 13, wherein the electric source is current adjustable, wherein the current is adjustable from 5 amps to 25 amps.

16. The radiant heating system of claim 13, wherein the electric source further comprises:

at least an upper heating element electrical line in electrical communication with the upper heating element connector on a first end and the electrical source on a second end;

where the upper heating element electrical line is an electrically conductive material;

at least a lower heating element electrical line in electrical communication with the lower heating element connector on a first end and the electrical source on a second end; and where the lower heating element electrical line is an electrically conductive material.

17. The radiant heating system of claim 15, wherein the electric source further comprises:

a second channel upper heating element electrical line in electrical communication with the upper heating element on a first end and the electrical source on a second end;

where the second channel upper heating element electrical line is an electrically conductive material;

a second channel lower heating element electrical line in electrical communication with the lower heating element on a first end and the electrical source on a second end; and where the second channel lower heating element electrical line is an electrically conductive material.

18. The radiant heating system of claim 1, further comprising at least one upper electrical bracket vent disposed on the upper bracket electrical plate.

19. The radiant heating system of claim 18, further comprising an electrical connector slot disposed in the lower bracket electrical plate or support.

20. The radiant heating system of claim 2, wherein the heating plate further comprises:

at least one heating plate projection disposed on the lower face of the heating plate body and extending from the lower face of the heating plate body, wherein the at least one heating plate projection is a semispherical projection, an arc-shaped tubular projection, a cylindrical projection, polygonal projection, a rectangular channel projection, a semispherical channel projection, or a combination thereof.

* * * * *